US008413985B2

(12) United States Patent
Yamazaki et al.

(10) Patent No.: US 8,413,985 B2
(45) Date of Patent: Apr. 9, 2013

(54) IMAGE FORMING SYSTEM, IMAGE FORMING APPARATUS, AND SHEET FEEDING APPARATUS WITH SIGNAL LINE FOR TRANSMITTING HANDOVER SIGNAL OUTPUT

(75) Inventors: Yoshitaka Yamazaki, Abiko (JP); Yuzo Matsumoto, Abiko (JP); Tomoharu Sato, Abiko (JP); Tetsuro Fukusaka, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/560,956

(22) Filed: Sep. 16, 2009

(65) Prior Publication Data

US 2010/0066012 A1 Mar. 18, 2010

(30) Foreign Application Priority Data

Sep. 17, 2008 (JP) ..... 2008-238077

(51) Int. Cl.
*B65H 5/34* (2006.01)

(52) U.S. Cl.
USPC ..... 271/270

(58) Field of Classification Search ..... 271/264, 271/270, 265.01
See application file for complete search history.

(56) References Cited

U.S. PATENT DOCUMENTS

| | | | | | |
|---|---|---|---|---|---|
| 4,504,906 | A | * | 3/1985 | Itaya et al. | 710/100 |
| 4,547,856 | A | * | 10/1985 | Piotroski et al. | 271/259 |
| 5,182,798 | A | * | 1/1993 | Francisco | 709/251 |
| 2007/0053700 | A1 | * | 3/2007 | Nishikata et al. | 399/21 |
| 2009/0261524 | A1 | * | 10/2009 | Nakayama et al. | 271/9.01 |
| 2011/0241289 | A1 | * | 10/2011 | Yamamoto et al. | 271/264 |

FOREIGN PATENT DOCUMENTS

| | | | | |
|---|---|---|---|---|
| JP | 10-186999 | A | | 7/1998 |
| JP | 10186999 | A | * | 7/1998 |
| JP | 2002-287575 | A | | 10/2002 |
| JP | 2002-287578 | A | | 10/2002 |
| JP | 2007-238311 | A | | 9/2007 |

* cited by examiner

*Primary Examiner* — Gerald McClain
(74) *Attorney, Agent, or Firm* — Rossi, Kimms & McDowell LLP

(57) ABSTRACT

An image forming system controls a handover timing of sheets between an image forming apparatus and a sheet feeding apparatus with high precision. A transmission path transmits information between the image forming apparatus and the sheet feeding apparatus. A signal line transmits a handover signal output from the image forming apparatus to the sheet feeding apparatus. A first control unit transmits the handover signal to the sheet feeding apparatus after transmitting a feeding start request to the sheet feeding apparatus. A second control unit controls the sheet feeding apparatus to convey the sheet to a predetermined position in the sheet feeding apparatus in accordance with a reception of the feeding start request and of conveying the sheet at the predetermined position to the image forming apparatus in accordance with a reception of the handover signal.

8 Claims, 15 Drawing Sheets

IMAGE FORMING SYSTEM, IMAGE FORMING APPARATUS, AND SHEET FEEDING APPARATUS WITH SIGNAL LINE FOR TRANSMITTING HANDOVER SIGNAL OUTPUT

BACKGROUND OF THE INVENTION

1. Field of the Invention

The present invention relates to an image forming system in which at least one sheet feeding apparatus is connected to an image forming apparatus, and further relates to the image forming apparatus and the sheet feeding apparatus.

2. Description of the Related Art

A conventional image forming system including an electrophotographic image forming apparatus such as a printer and a copier for office use has the following configuration. When a sheet feeding apparatus is connected to the image forming apparatus as an additional apparatus for feeding sheets, a CPU in the image forming apparatus is configured to directly control conveyance controls of the sheet feeding apparatus.

However, as the image forming apparatus and the additional apparatus grow into large scale, the image forming system such as a printing machine needing to convey sheets at a fast speed in the apparatus and between apparatuses has various additional apparatuses connected to the image forming apparatus. Therefore, when the additional apparatus is directly controlled, an operational performance of the CPU needs to be greatly improved, thus resulting in a disadvantageous cost.

Further, the length of a harness for the direct control becomes very long according to the scale of the apparatus, which reduces the reliability of the system with regard to malfunction caused by EMI (Electromagnetic Interference) and ease of maintenance, thus also resulting in a disadvantageous cost.

Taking the above into consideration, the following configuration has been made: each of the additional apparatus, e.g., a sheet feeding apparatus, has a CPU for controlling the apparatus itself, and this CPU and the CPU in the image forming apparatus are connected by a serial bus and the like, so that the harness is simplified, and a state of each of the apparatuses is notified to each other via the serial bus. In this way, controlling the image forming apparatus without improving the performance of the CPU has been a generally used technique.

However, in the image forming system in the field of printing, a faster speed and a higher productivity is required in sheet conveyance. For a shorter conveyance interval between sheets and a faster conveyance speed of sheets, when a feeding timing is notified from the sheet feeding apparatus using the serial bus, the sheet feeding interval varies according to a delay amount of a communication delay, thus reducing the productivity in the sheet conveyance. Further, if a timing margin is increased to allow for error in timing caused by the communication delay that is not necessarily constant, the original accuracy in the conveyance would be lost. As a result, there is a possibility that a positional shift of an image, a jam, and the like may occur in the image forming apparatus arranged downstream.

In relation to this, Japanese Laid-Open Patent Publication (Kokai) No. 2002-287578 discloses an image forming apparatus to which a plurality of feeding units can be connected, wherein each of the feeding units and a printer unit has its own CPU, and the feeding units and the printer unit are connected via a bus (for example, a serial bus). In this image forming apparatus, control signal lines of the feeding units carrying a driving load, a sensor input, and the like are put together into the bus, so that a harness is simplified. However, a control of feeding and conveyance affects a timing of an image formation performed by the image forming apparatus arranged downstream. Therefore, each timing signal indicating a start of feeding operation is individually arranged, separately from the bus, between the feeding unit and the printer unit so as not to reduce an accuracy of a timing control in a feeding operation.

However, the following problems arise when the constitution of the above conventional image forming apparatus is applied to the above image forming system in the field of printing: a conveyance path used during a period from a timing when a timing signal notifies the sheet feeding apparatus of a start of feeding operation to feed a sheet from a sheet container to a timing when the fed sheet is passed to the image forming apparatus becomes very long. Therefore, as a result, a conveyance delay and the like caused by slipping of rollers during the feeding and conveyance makes it difficult for the sheet feeding apparatus to accurately pass a sheet to the image forming apparatus at a suitable time with respect to a timing of an image formation in the image forming apparatus.

Further, when the image formation is performed by the image forming apparatus without taking any measure, a timing error becomes large, and there is a possibility that a jam and a positional shift of an image occur. Further, it is necessary to give a timing signal for a feeding operation to each of the sheet feeding apparatuses. In this case, since the image forming apparatus and the sheet feeding apparatuses themselves are large scale, the signal lines are very long although the number of signal lines are a few, and therefore, the signal lines tend to be affected by a malfunction caused by EMI, thus reducing the reliability of the apparatus.

Further, when an abnormal condition occurs in a feeding start timing signal serving as a starting point of a feeding operation, such as breaking of a wire, short-circuit with a casing metal plate, and contact failure of a connector, the starting point of the feeding control is lost, and there is a possibility that the entire image forming system stops in an error state. Preventing interference between a signal wiring path and an edge of the casing metal plate and strengthening an insulation coating of the signal line can be considered as measures for preventing such abnormal conditions of the signal, but such measures result in increasing the cost.

SUMMARY OF THE INVENTION

The present invention provides an image forming system, an image forming apparatus, and a sheet feeding apparatus, capable of controlling a handover timing of sheets between the image forming apparatus and the sheet feeding apparatus at high precision. Further, the present invention provides an image forming system, an image forming apparatus, and a sheet feeding apparatus that allow a user to continuously use the system without stopping the entire system when a handover timing signal is abnormal.

Accordingly, a first aspect of the present invention provides an image forming system including an image forming apparatus for forming an image on a sheet and a sheet feeding apparatus for feeding the sheet to the image forming apparatus, the image forming system comprising a transmission path adapted to connect the image forming apparatus and the sheet feeding apparatus and transmit information between the image forming apparatus and the sheet feeding apparatus, and a signal line adapted to connect the image forming apparatus and the sheet feeding apparatus and transmit a handover signal output from the image forming apparatus to the sheet feeding apparatus, wherein the image forming apparatus has a first control unit for transmitting the handover signal to the sheet feeding apparatus via the signal line after the first control unit transmits a feeding start request to the sheet feeding apparatus via the transmission path, and the sheet feeding apparatus has a second control unit for performing a control of conveying the sheet to a predetermined position in the sheet feeding apparatus in accordance with a reception of the feeding start request via the transmission path and for performing a control of conveying the sheet at the predetermined position to the image forming apparatus in accordance with a reception of the handover signal via the signal line.

According to the first aspect of the present invention, the sheet feeding apparatus performs the control of conveying the sheet to the predetermined position in the sheet feeding apparatus in accordance with the reception of the feeding start request via the transmission path and performs the control of conveying the sheet at the predetermined position to the image forming apparatus in accordance with the reception of the handover signal via the signal line. Accordingly, a handover timing between the image forming apparatus and the sheet feeding apparatus can be controlled at high precision. Therefore, a decrease of productivity, a jam, and a positional shift of an image due to a shift in conveyance timing do not occur. As a result, the sheets can be fed with a shorter sheet interval therebetween. Further, the image forming system does not increase the number of signal lines, and the signal lines can be configured easily with only harnesses, thus improving the reliability of the apparatus, feeding ease of maintenance, and reducing the cost. Further, even when a plurality of sheet feeding apparatuses are connected to the image forming apparatus, the same advantages can be obtained by controlling only the handover timing to the sheet feeding apparatus arranged immediately upstream thereof.

Accordingly, a second aspect of the present invention provides an image forming system including an image forming apparatus for forming an image on a sheet, a first sheet feeding apparatus for directly feeding the sheet to the image forming apparatus, and a second sheet feeding apparatus for feeding the sheet to the image forming apparatus via the first sheet feeding apparatus, the image forming system comprising a transmission path adapted to connect the image forming apparatus and the first and second sheet feeding apparatuses and transmit information between the image forming apparatus and the first and second sheet feeding apparatuses, and a signal line adapted to connect the image forming apparatus and the first sheet feeding apparatus and transmit a handover signal output from the image forming apparatus to the first sheet feeding apparatus, wherein the image forming apparatus has a first control unit for transmitting the handover signal to the first sheet feeding apparatus via the signal line after the first control unit transmits a feeding start request to the first and second sheet feeding apparatuses via the transmission path, the first sheet feeding apparatus has a second control unit for performing a control of conveying the sheet to a predetermined position in the first sheet feeding apparatus in accordance with a reception of the feeding start request via the transmission path and for performing a control of conveying the sheet at the predetermined position to the image forming apparatus in accordance with a reception of the handover signal via the signal line, and the second sheet feeding apparatus has a third control unit for performing a control of conveying the sheet to the first sheet feeding apparatus in accordance with a reception of the feeding start request via the transmission path.

Accordingly, a third aspect of the present invention provides an image forming apparatus for forming an image on a sheet fed from a first sheet feeding apparatus feeding the sheet and from a second sheet feeding apparatus feeding the sheet via the first sheet feeding apparatus, the image forming apparatus comprising a transmission path adapted to connect the image forming apparatus and the first and second sheet feeding apparatuses and transmit information between the first and second sheet feeding apparatuses, a signal line adapted to connect the image forming apparatus and the first sheet feeding apparatus and transmit a handover signal to the first sheet feeding apparatus, and a control unit adapted to transmit the handover signal to the first sheet feeding apparatus via the signal line after the first control unit transmits a feeding start request to the first and second sheet feeding apparatuses via the transmission path.

Accordingly, a fourth aspect of the present invention provides a sheet feeding apparatus for directly feeding a sheet to an image forming apparatus forming an image on the sheet and for receiving the sheet from another sheet feeding apparatus and feeding the received sheet to the image forming apparatus, the sheet feeding apparatus comprising a transmission path adapted to connect the image forming apparatus and the sheet feeding apparatus and transmit information between the image forming apparatus and the sheet feeding apparatus, a signal line adapted to connect the image forming apparatus and the sheet feeding apparatus and receive a handover signal output from the image forming apparatus, and a control unit adapted to perform a control of conveying the sheet to a predetermined position in the sheet feeding apparatus in accordance with a reception of a feeding start request via the transmission path and perform a control of conveying the sheet at the predetermined position to the image forming apparatus in accordance with a reception of the handover signal via the signal line.

The features and advantages of the invention will become more apparent from the following detailed description taken in conjunction with the accompanying drawings.

DESCRIPTION OF THE EMBODIMENTS

Embodiments of an image forming system, an image forming apparatus, and a sheet feeding apparatus according to the present invention will be described with reference to the drawings. The image forming system according to the present embodiment is applied to an image forming system in which a plurality of sheet feeding apparatuses are connected to an image forming apparatus in such a manner that the plurality of sheet feeding apparatuses can feed sheets to the image forming apparatus.

Figure 1:
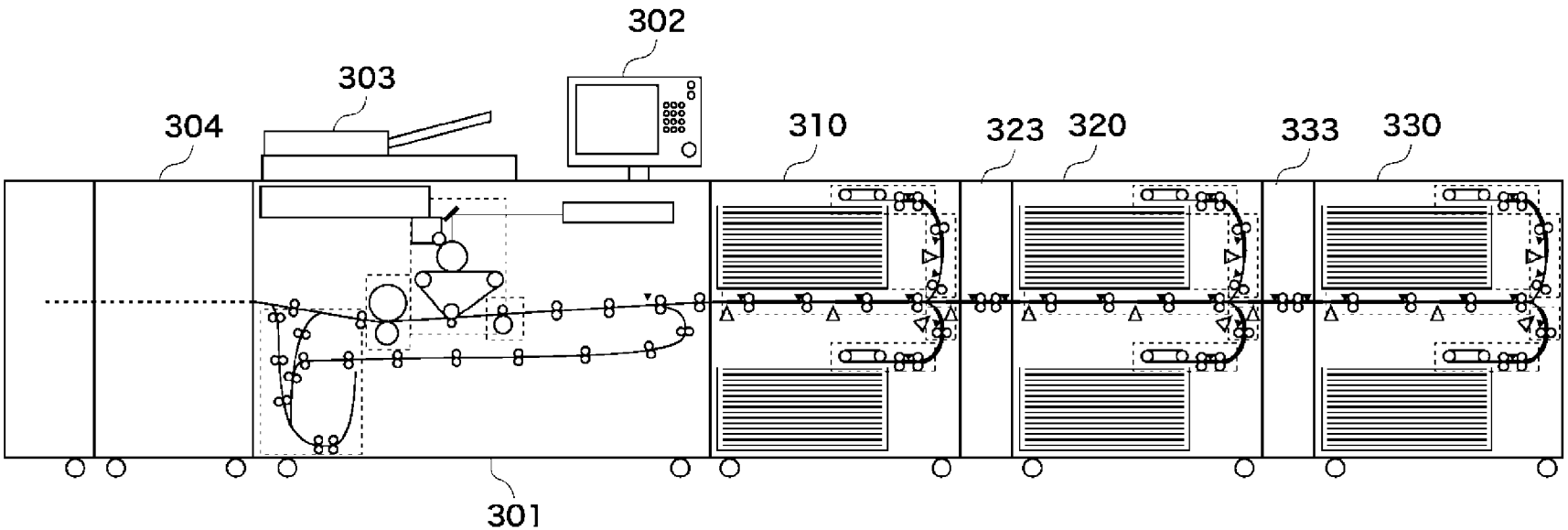
FIG. 1 is a figure schematically showing the entire configuration of an image forming system according to the first embodiment.
Figure 2:
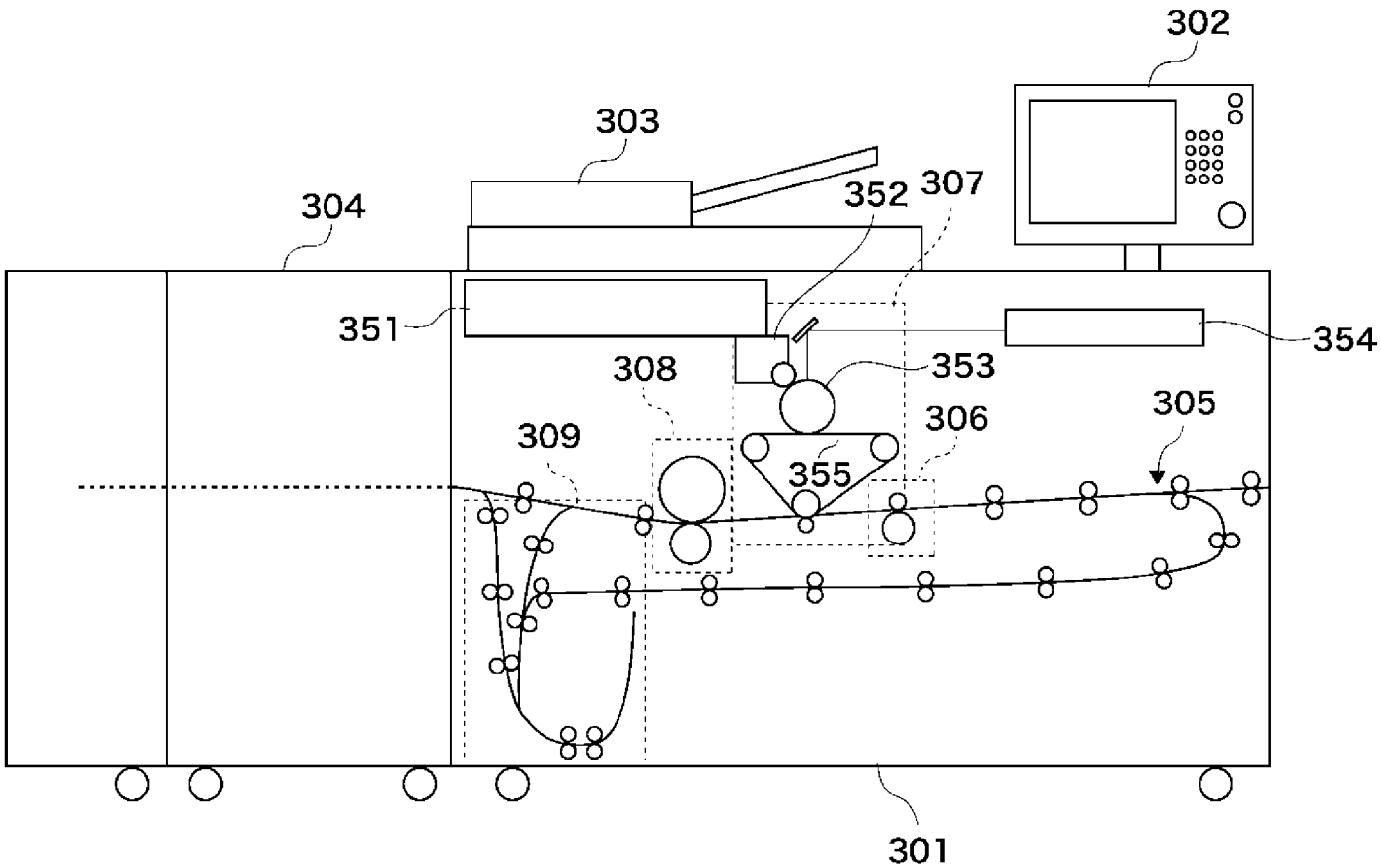
FIG. 2 is a figure schematically showing the internal configuration of the image forming apparatus of FIG. 1.
Figure 3:
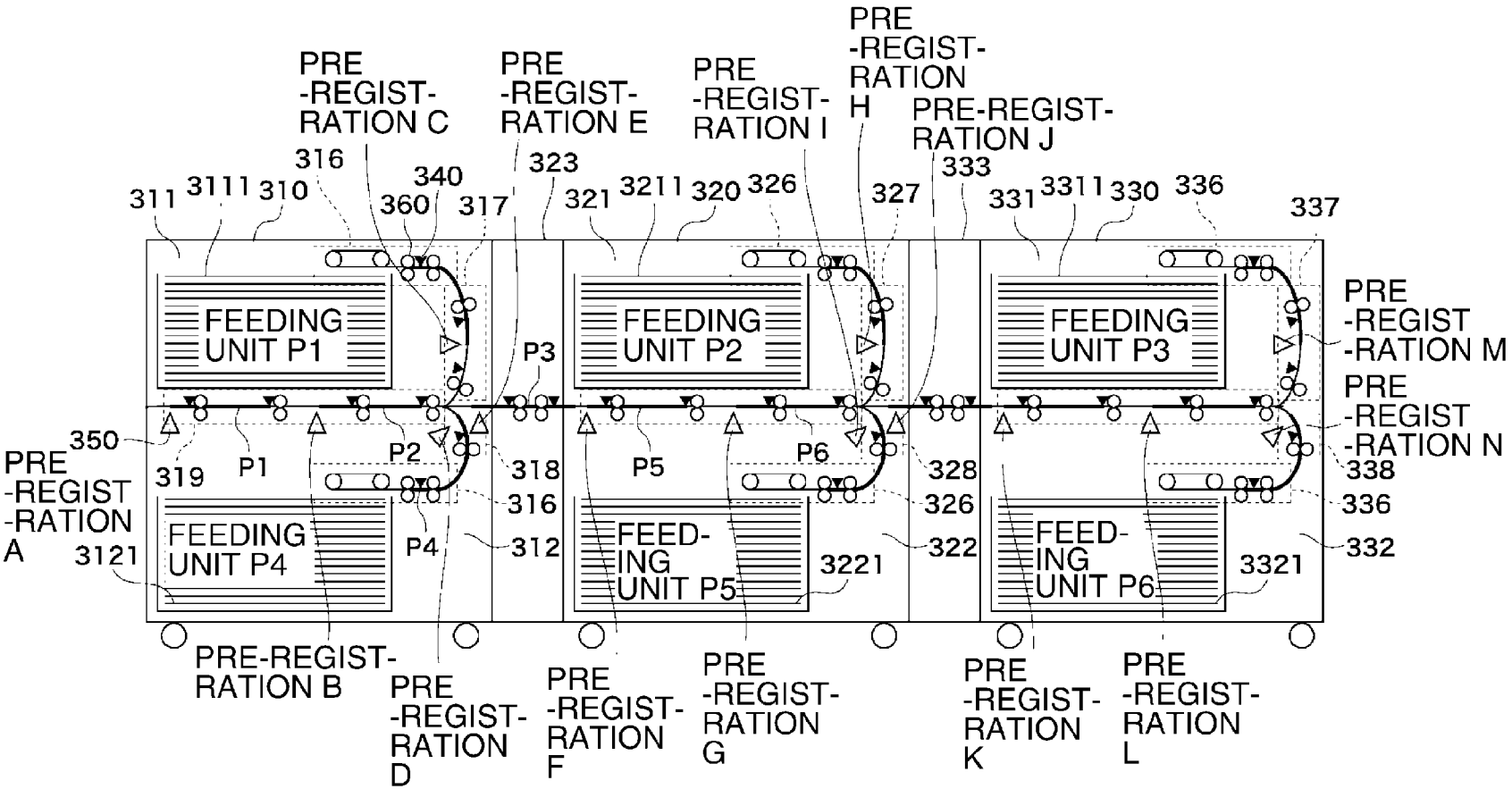
FIG. 3 is a figure schematically showing an internal configuration of a sheet feeding apparatuses of FIG. 1.

FIG. 1 is a figure schematically showing the entire configuration of the image forming system according to the first embodiment. This image forming system is configured such that three sheet feeding apparatuses 310, 320 and 330 are connected to an image forming apparatus 301. In particular, the sheet feeding apparatus 310 is directly connected to the image forming apparatus 301. FIG. 2 is a figure schematically showing the internal configuration of the image forming apparatus 301 of FIG. 1. FIG. 3 is a figure schematically showing an internal configuration of the sheet feeding apparatuses 310, 320 and 330 of FIG. 1. It should be noted that since the three sheet feeding apparatuses 310, 320 and 330 have almost the same configuration, the configuration of the sheet feeding apparatus 310 will be mainly explained.

The sheet feeding apparatus 310 (a first sheet feeding apparatus) has two feeding units 311 and 312. The feeding units 311 and 312 are arranged with containers 3111 and 3121, respectively, for storing a bundle of sheets. The sheet feeding apparatus 310 directly feeds a sheet in the bundle of sheets stored in the containers 3111 and 3121 to the image forming apparatus 301 as necessary.

A plurality of conveyance sensors 340 (indicated as black-filled triangles in the figures) for detecting a sheet passing thereon are arranged on conveyance paths in which sheets are conveyed. A feeding operation is performed by a feeding and conveyance unit 316 arranged on each of the feeding units 311 and 312. The feeding unit 311 arranged above is referred to as an upper feeding unit, and the feeding unit 312 arranged below is referred to as a lower feeding unit. In the present embodiment, air feeding control is performed, and the feeding and conveyance unit 316 is arranged with a plurality of fans (not shown). During the feeding operation, the fans are controlled so as to blow air from the upstream of the conveyance direction into between the sheets in the containers 3111 and 3121. When a sheet is flipped, the sheet is sucked to an endless belt by a sheet sucking fan arranged inside the endless belt in the feeding and conveyance unit 316, so that the sheets are fed and conveyed sheet by sheet.

In a case of the upper feeding unit 311, a sheet having been conveyed is continuously conveyed by a upper conveyance unit 317. In a case of the lower feeding unit 312, a sheet having been conveyed is continuously conveyed by the lower conveyance unit 318, and is continuously conveyed by a joined conveyance unit 319 in which the sheet fed from the upper conveyance unit 317 and the sheet fed from the lower conveyance unit 318 join. Each of the conveyance units, i.e., the upper conveyance unit 317, the lower conveyance unit 318, and the joined conveyance unit 319, is arranged with a stepping motor (not shown) for conveyance. A conveyance control unit controls each stepping motor to mechanically transmit driving force of the stepping motor to rotate a conveyance roller 360 arranged in each conveyance unit so as to convey sheets.

A plurality of temporary sheet waiting positions (pre-registration positions) 350 (indicated as white-filled triangles in the figures) for conveying sheets in order and providing a conveyance timing for the sheet conveyance control are arranged in each conveyance unit.

The upper conveyance unit 317 is arranged with a pre-registration C. Further, the lower conveyance unit 318 is arranged with a pre-registration D. Further, the joined conveyance unit 319 is arranged with pre-registrations A and B. Each of the pre-registrations 350 is arranged at a position away by a predetermined distance from a detection position of the conveyance sensor 340 arranged immediately upstream of the pre-registration, and is used as a waiting position of a sheet for the conveyance control.

As described above, the configuration of the sheet feeding apparatus 310 and the configuration of the sheet feeding apparatuses 320 and 330 connected upstream thereof are the same. Namely, in these sheet feeding apparatuses, the feeding units, the conveyance paths, the pre-registration position settings, and the conveyance sensor positions are the same. It should be noted that these reference numerals are as shown in the figure.

However, the configuration of the sheet feeding apparatus 310 and the configuration of the sheet feeding apparatuses 320 and 330 connected upstream thereof are different in a connection unit 323 of the sheet feeding apparatus 310 and a connection unit 333 of the sheet feeding apparatus 320. The connection unit 323 is arranged between the sheet feeding apparatus 310 and the sheet feeding apparatus 320. The connection unit 333 is arranged between the sheet feeding apparatus 320 and the sheet feeding apparatus 330. These connection units 323 and 333 are connected to the sheet feeding apparatuses 320 and 330, respectively. The connection units 323 and 333 are arranged with a motor and conveyance sensors 340 and are controlled by the connected sheet feeding apparatus. The connection units 323 and 333 performs such a conveyance operation to receive sheets from joined conveyance units 329 and 339, respectively, (both of which are not shown) of the respective, connected sheet feeding apparatuses, and to pass the sheets to the joined conveyance units 319 and 329 of the downstream sheet feeding apparatuses 310 and 320, respectively. It should be noted that these connection units 323 and 333 are also arranged with pre-registrations.

In accordance with received image data, an image forming control unit 401 (see FIG. 4) exchanges information, via a bus, with the sheet feeding apparatuses 310, 320, 330 or a discharge processing apparatus 304 connected to a downstream side of the image forming apparatus 301, and forms images in sequence. The discharge processing apparatus 304 performs post processings such as folding, cutting, stapling, punching, and the like on a sheet on which an image has been formed.

Further, an operation unit 302 for allowing a user to configure operational settings of the image forming system and a reader scanner (a reader unit) 303 for reading an original image are arranged on the upper portion of the image forming apparatus 301.

After receiving a sheet from the sheet feeding apparatus 310 connected immediately upstream thereof, the image forming apparatus 301 controls each of the conveyance units to convey the sheet, and performs an image forming operation based on image data received by an image generating unit 307, using sheet detection performed by an image reference sensor 305 as a start position. In the image forming operation, the image forming control unit 401 controls turning on and off and the amount of light of a semiconductor laser in a laser scanner unit 354. Further, the image forming control unit 401 controls a scanner motor for controlling rotation of a polygon mirror (not shown), so that a latent image is formed on a photosensitive drum 353 by a laser light on the basis of the image data.

A developing unit 352, to which toner is supplied from a toner bottle 351, develops the latent image on the photosensitive drum 353 with toner. This developed toner image is primarily transferred from the photosensitive drum 353 to an intermediate transfer belt 355.

The toner image primarily transferred onto the intermediate transfer belt 355 is secondarily transferred onto a sheet, so that the toner image is formed on the sheet. A registration control unit 306 is arranged just before a secondary transfer position. The registration control unit 306 performs a skew correction and a sheet conveyance control on the sheet conveyed to just before the transfer position without stopping the sheet. In the sheet conveyance control, the toner image formed on the intermediate transfer belt 355 and the position of the front edge of the sheet are finely adjusted.

The sheet having been subjected to the secondary transfer is conveyed to a fixing unit 308. The fixing unit 308 fuses toner by applying heat and pressure to the sheet, so that the toner is fixed to the sheet. When the back surface of the fixed sheet is subsequently printed, or when it is necessary to turn over the sheet, the sheet is conveyed to an inversion conveyance unit 309. When the print is finished, the sheet is continuously conveyed to the discharge processing apparatus 304 arranged downstream.

Figure 4:
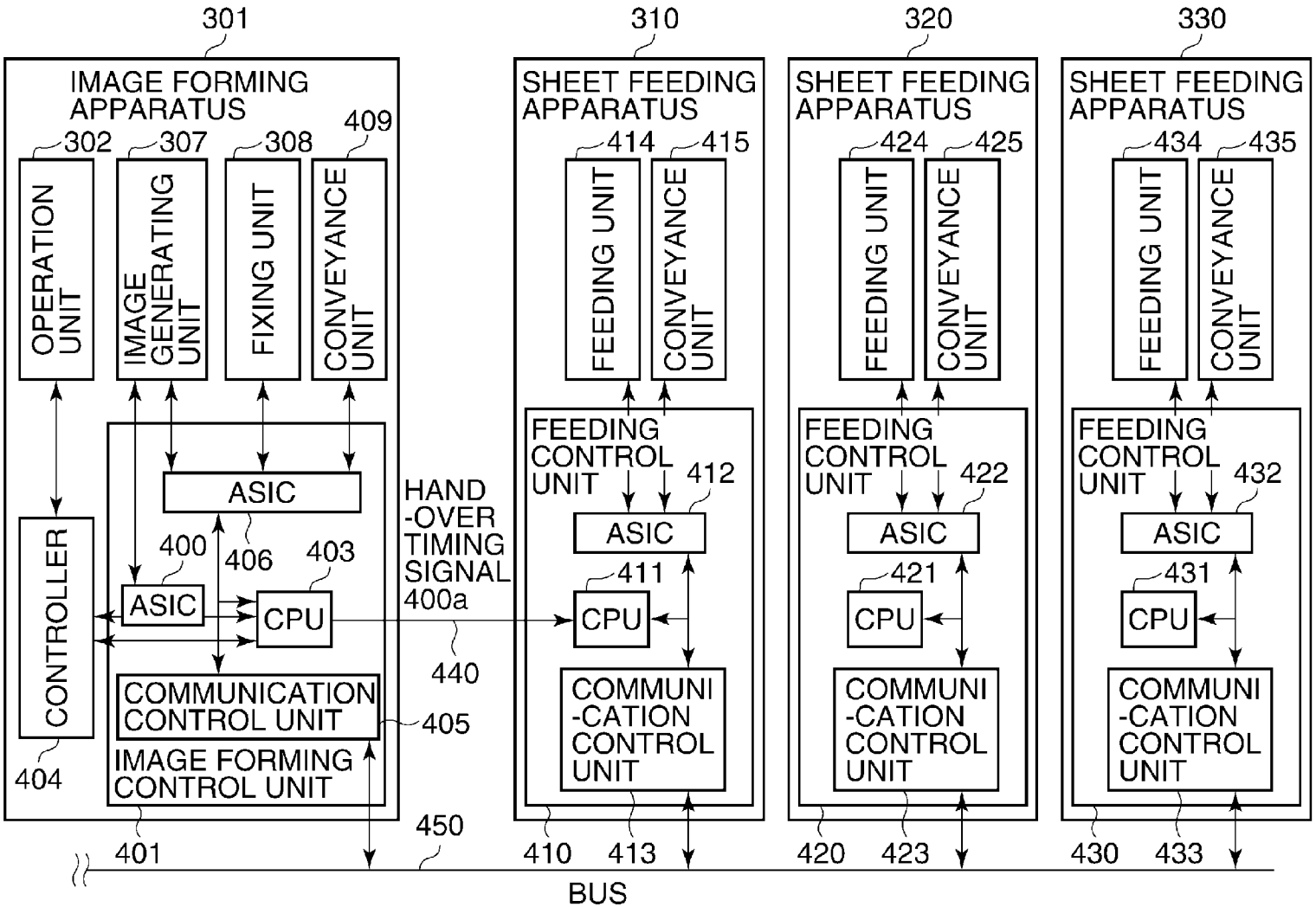
FIG. 4 is a block diagram schematically showing a configuration of a control unit related to sheet conveyance in the image forming system.

FIG. 4 is a block diagram schematically showing a configuration of a control unit related to the sheet conveyance in the image forming system. A user makes a job request to the image forming apparatus 301 via the operation unit 302, a network (not shown), a USB (not shown), and the like as a PC external input.

Image information is sent to a controller 404 in the image forming apparatus 301 from the reader unit 303 during copy operation or from the network during print operation. In the controller 404, an image processing is performed on the received image information so as to process the image information as specified by a user and process the image information into an image form suitable for the image forming apparatus 301.

Further, in addition to the processed image information, various status information such as an image size, page information, used feeding unit information, discharge processing information, and the like is transmitted to the image forming control unit 401 in the image forming apparatus 301. The image forming apparatus 301, the plurality of sheet feeding apparatuses 310, 320 and 330 connected thereto, and the discharge processing apparatus 304 are connected to each other via a bus 450. The bus 450 is comprised of a general-purpose serial bus capable of multiple connection such as I2C (trademark) and ARCNET (registered trademark). Namely, the bus 450 allows the image forming apparatus 301 to multi-connect to the plurality of sheet feeding apparatuses 310, 320 and 330 and the discharge processing apparatus 304.

Further, a handover timing signal line 440 for transmitting a handover timing signal 440*a* is arranged, separately from the bus 450, only between the image forming apparatus 301 and the sheet feeding apparatus 310 connected immediately upstream thereof. The handover timing signal 440*a* serves as a signal indicating a starting point when a sheet waiting at the pre-registration A, i.e., the most downstream pre-registration in the sheet feeding apparatus 310, is passed and conveyed to the image forming apparatus 301. When sheets waiting at the other pre-registrations, i.e., pre-registrations F and K, are passed and conveyed between the sheet feeding apparatuses, a sheet handover timing is notified via the bus 450. The sheets at other pre-registrations are conveyed by the feeding control unit in each of the sheet feeding apparatuses.

The handover and conveyance from the pre-registrations F and K via the bus 450 is performed at a sufficiently faster speed than a speed of the handover and conveyance using the handover timing signal 440*a* in order to absorb the delay of the conveyance timing due to communication delay. The speed of the handover and conveyance using the handover timing signal 440*a* is the same as a conveyance speed in the image forming apparatus 301. The conveyance speed in the image forming apparatus 301 is configured to be the fastest speed as long as a quality of image formation such as a fixing property and a transfer property are satisfactory. Since the sheet feeding apparatus does not have such restrictions, a faster conveyance speed than that in the image forming apparatus can be easily set in the sheet feeding apparatus.

Further, the image forming control unit 401 is arranged with a CPU 403. The CPU 403 is connected to the controller 404 via communication. The CPU 403 not only exchanges status information but also exchanges image data with the controller 404 via an ASIC 400 and controls a timing thereof.

Further, the CPU 403 is connected to the bus 450 via a communication control unit 405 and exchanges status information of each of the sheet feeding apparatuses and performs the conveyance control. In addition, the CPU 403 gives a control instruction to each unit in the apparatus such as the image generating unit 307, the fixing unit 308, and a conveyance unit 409 in the image forming apparatus 301 via an ASIC 406. Further, the CPU 403 detects a state, and performs an image forming control and a sheet conveyance control therewith. The conveyance unit 409 includes the registration control unit 306, the duplex conveyance unit 309, and the like, and is a portion related to the conveyance of a sheet after the sheet is received.

The ASIC 400 is also connected to the image generating unit 307, and converts the image data from the controller 404 into a laser control signal and transmits the laser control signal.

A feeding control unit 410 arranged in the sheet feeding apparatus 310 performs a feeding control on the basis of an entire load of the sheet feeding apparatus 310 and sensor information. A CPU 411 is arranged in the feeding control unit 410. When the handover timing signal 440*a* from the image forming apparatus 301 is input to the CPU 411, the CPU 411 performs a handover and conveyance of a sheet between the image forming apparatus 301 and the sheet feeding apparatus 310, using this signal as a starting point. Further, the CPU 411 exchanges status information with peripheral apparatuses connected via a communication control unit 413 and performs the conveyance control. Further, the CPU 411 performs a conveyance control on a feeding unit 414, the upper conveyance unit 317, and a conveyance unit 415 via an ASIC 412. The feeding unit 414 includes the feeding units 311 and 312 performing feeding controls. The upper conveyance unit 317 conveys a sheet after the sheet is fed. The conveyance unit 415 includes the lower conveyance unit 318 and the joined conveyance unit 319.

It should be noted that the control units related to the sheet feeding in the sheet feeding apparatuses 320 and 330 have the same configuration as the sheet feeding apparatus 310 except the handover timing signal line 440. It should be noted that the sheet feeding apparatuses 310, 320 and 330 are different apparatuses, and therefore, in the figures, different reference numerals are assigned to corresponding portion of a different apparatus even where the portions have the same function.

Figure 5:
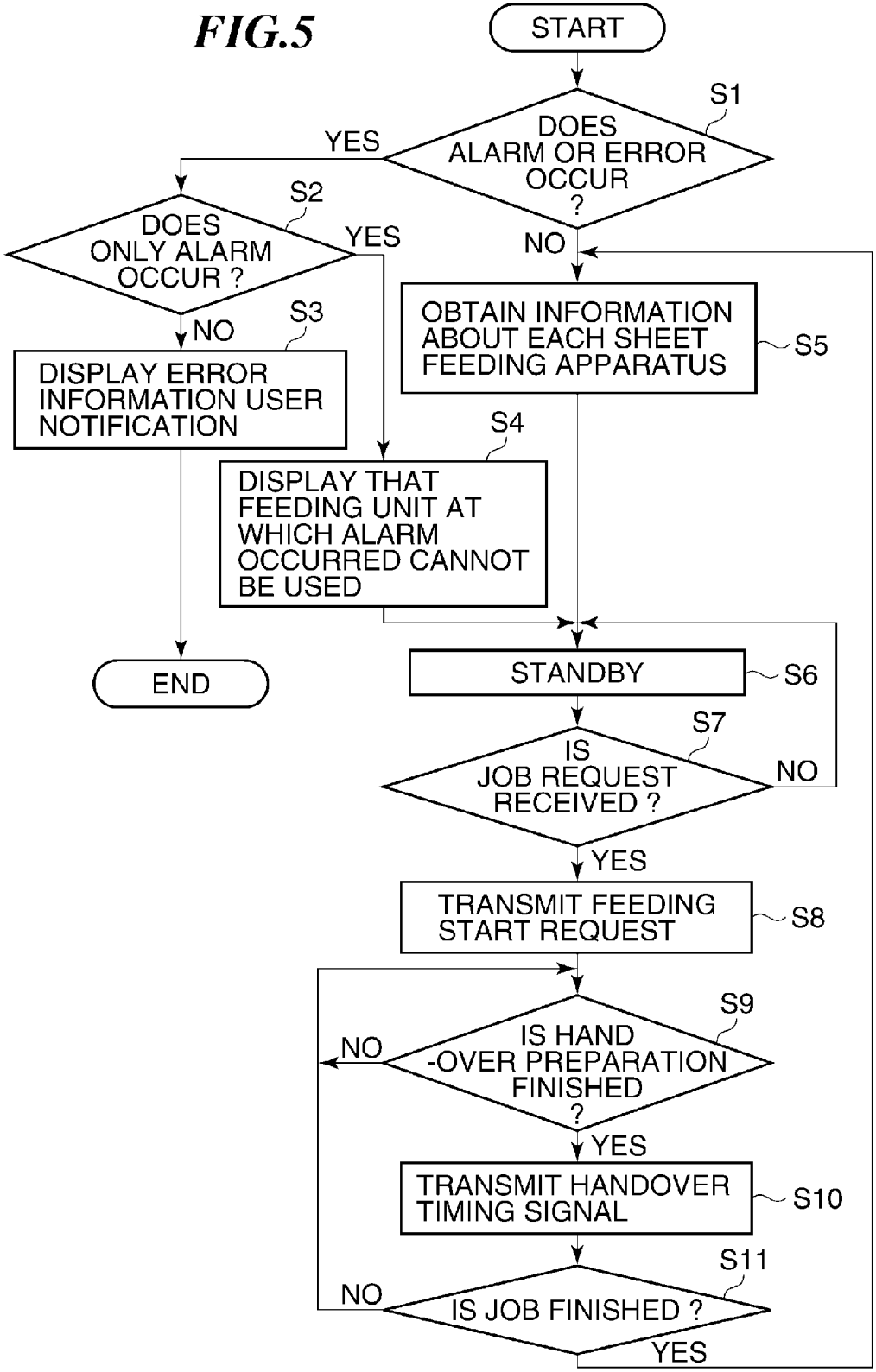
FIG. 5 is a flowchart showing sheet feeding operational procedures of each of the sheet feeding apparatuses of the image forming apparatus.

FIG. 5 is a flowchart showing sheet feeding operational procedures of each of the sheet feeding apparatuses of the image forming apparatus 301. This processing program is stored in a storage medium in the image forming control unit 401. After power on, the CPU 403 executes the processing program.

The image forming control unit 401 performs a predetermined initial control after power on. Namely, as one of the initial control, the image forming control unit 401 inquires, via the bus 450, if there is any abnormality or not in the apparatus state of each of the sheet feeding apparatuses, receives data of an alarm and an error, and determines whether the alarm or the error occurs or not (step S1).

The alarm indicates an abnormal condition of the apparatus to such a degree that the entire image forming system does not need to be stopped, such as an abnormality of some of the sensor outputs in the feeding unit and a communication abnormality of the sheet feeding apparatus. The error is a state where a power source abnormality or an abnormality possibly resulting in breaking the feeding unit is detected, and indicates an abnormal condition of the apparatus to such a degree that the entire sheet feeding apparatus needs to be stopped.

When only the alarm or the error occurs, the image forming control unit 401 determines whether only the alarm occurs (step S2). When only the alarm occurs, the image forming control unit 401 prohibits the use of the feeding unit at which the alarm occurs, and makes such a setting that a user cannot select it (step S4). Further, at this occasion, the image forming control unit 401 displays the disabled feeding unit on the operation unit 302. Thereafter, the image forming control unit 401 proceeds to a processing in step S6.

When the error occurs in step S2, the image forming control unit 401 notifies error information to a user (step S3). When the error occurs, an abnormality is considered to occur in the apparatus, and therefore, information notified to the user is changed in accordance with the degree of seriousness. The user is notified by a display on the operation unit 302 or by a printer driver via the network. Thereafter, the image forming control unit 401 terminates this processing.

When the abnormality is not detected in step S1, the image forming control unit 401 receives information about each of the sheet feeding apparatuses via the bus 450 (step S5). The information about the sheet feeding apparatus means information about whether there is any sheet or not, information about the remaining number of sheets, and the like. Other sheet information is input from the operation unit 302 of the image forming apparatus 301 or from a printer driver connected to the network after the user sets sheets on the sheet feeding apparatus, and is notified to the image forming control unit 401 via the controller. The other sheet information includes a sheet size, a basis weight, a surface property, and the like.

After the initial control is finished, the image forming control unit 401 goes into a standby state (step S6). The image forming control unit 401 determines whether the image forming control unit 401 has received a job request from the controller 404 or not (step S7). When the image forming control unit 401 has not received any job request, the image forming control unit 401 causes the operation to return back to the processing in step S6.

When receiving a job request, the image forming control unit 401 transmits a feeding start request to the sheet feeding apparatus via the bus 450 along with the image formation in order to perform the job (step S8). The feeding start request is attached with a sheet size, a basis weight, a surface property, and a page ID. The number of times corresponding to the number of sheets of the job is transmitted to the sheet feeding apparatus corresponding to a specified feeding unit. The page ID is information representing the page number in the job, and the sheets are controlled to reach the pre-registration A in the order of this page ID.

After the feeding start request is received, the feeding unit of each of the sheet feeding apparatuses feeds a sheet in accordance with the page ID, and the handover control is performed between the sheet feeding apparatuses via the bus 450. The handover control between the sheet feeding apparatuses will be described later using an exemplary job.

The sheet feeding apparatus 310 arranged immediately upstream of the image forming apparatus 301 notifies to the image forming control unit 401 via the bus 450 a handover preparation completion meaning that the sheet feeding apparatus 310 is ready to pass a sheet to the image forming apparatus 301. The image forming control unit 401 keeps the image forming operation waiting until receiving the handover preparation completion from the sheet feeding apparatus 310 (step S9).

When receiving the handover preparation completion, the image forming control unit 401 transmits the handover timing signal 440*a* to the sheet feeding apparatus 310 arranged immediately upstream of the image forming apparatus 301 (step S10). The image forming control unit 401 not only transmits the handover timing signal 440*a* but also performs the conveyance control on the conveyance unit 409 on the image forming apparatus 301 side to receive the sheet from the sheet feeding apparatus 310.

When receiving the handover timing signal 440*a*, the sheet feeding apparatus 310 conveys one sheet waiting at the position of the pre-registration A to the image forming apparatus 301. Further, when the job includes a plurality of sheets, the sheet feeding apparatus similarly conveys a subsequent sheet waiting at the position of the pre-registration arranged upstream in the conveyance path, and causes the subsequent sheet to wait at the position of the pre-registration downstream thereof again. The sheet feeding apparatus 310 notifies to the image forming apparatus 301 via the bus 450 that the sheet feeding apparatus 310 is ready to pass a sheet to the image forming apparatus 301 again.

Then, the image forming control unit 401 determines whether a job is finished, i.e., whether a predetermined number of pages in the job have been passed and conveyed (step S11), and the processings in step S9 to step S11 are repeated until the job is finished. After the job is finished, the image forming control unit 401 causes the operation to return back to the processing in step S5, and by repeating the same processings, the image forming control unit 401 continuously feeds and conveys sheets from the plurality of sheet feeding apparatuses to the image forming apparatus 301.

Figure 6:
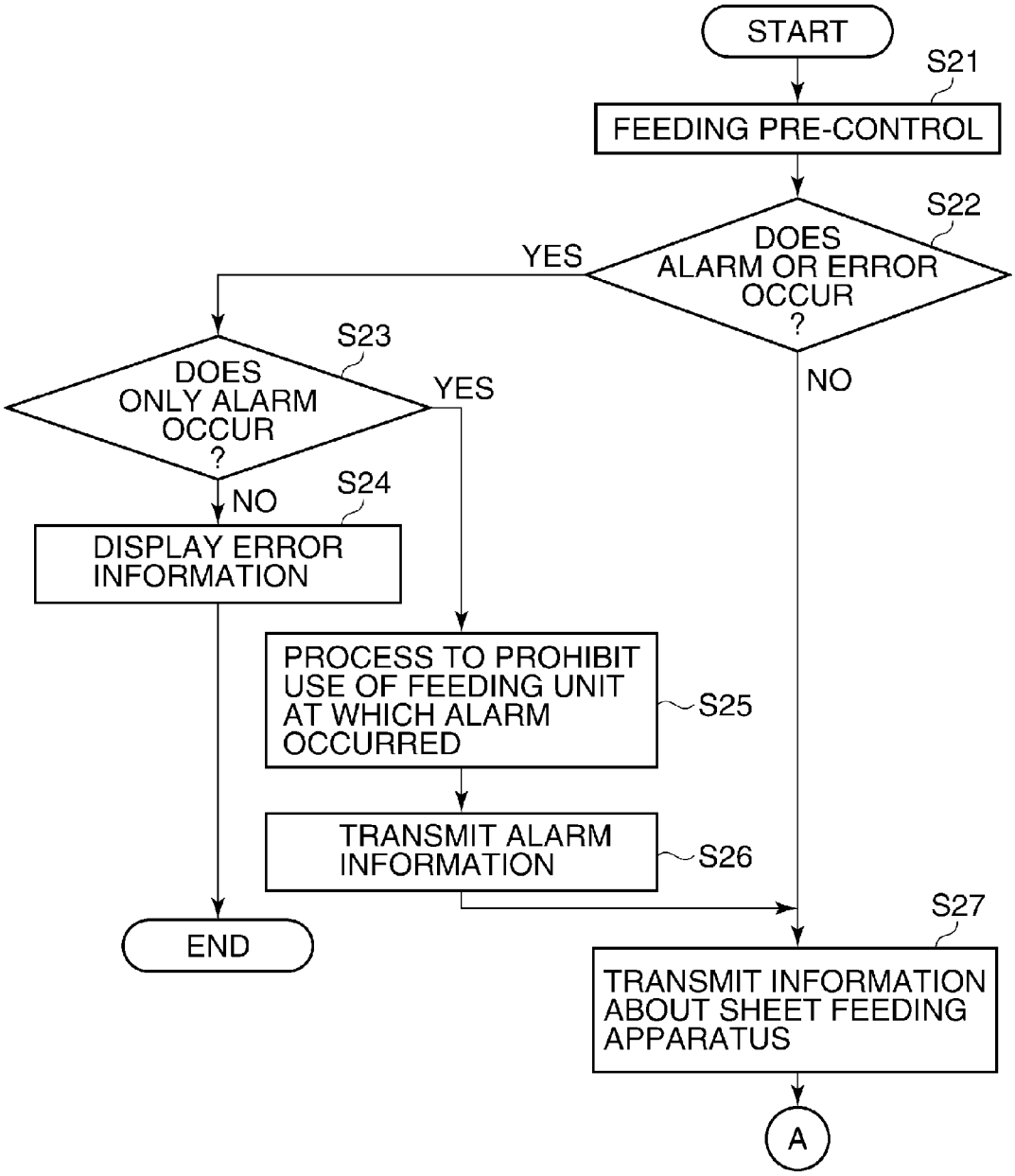
FIG. 6 is a flowchart showing operational procedures of the sheet feeding apparatus for feeding sheets to the image forming apparatus and for handing over and conveying sheets between the apparatuses.
Figure 7:
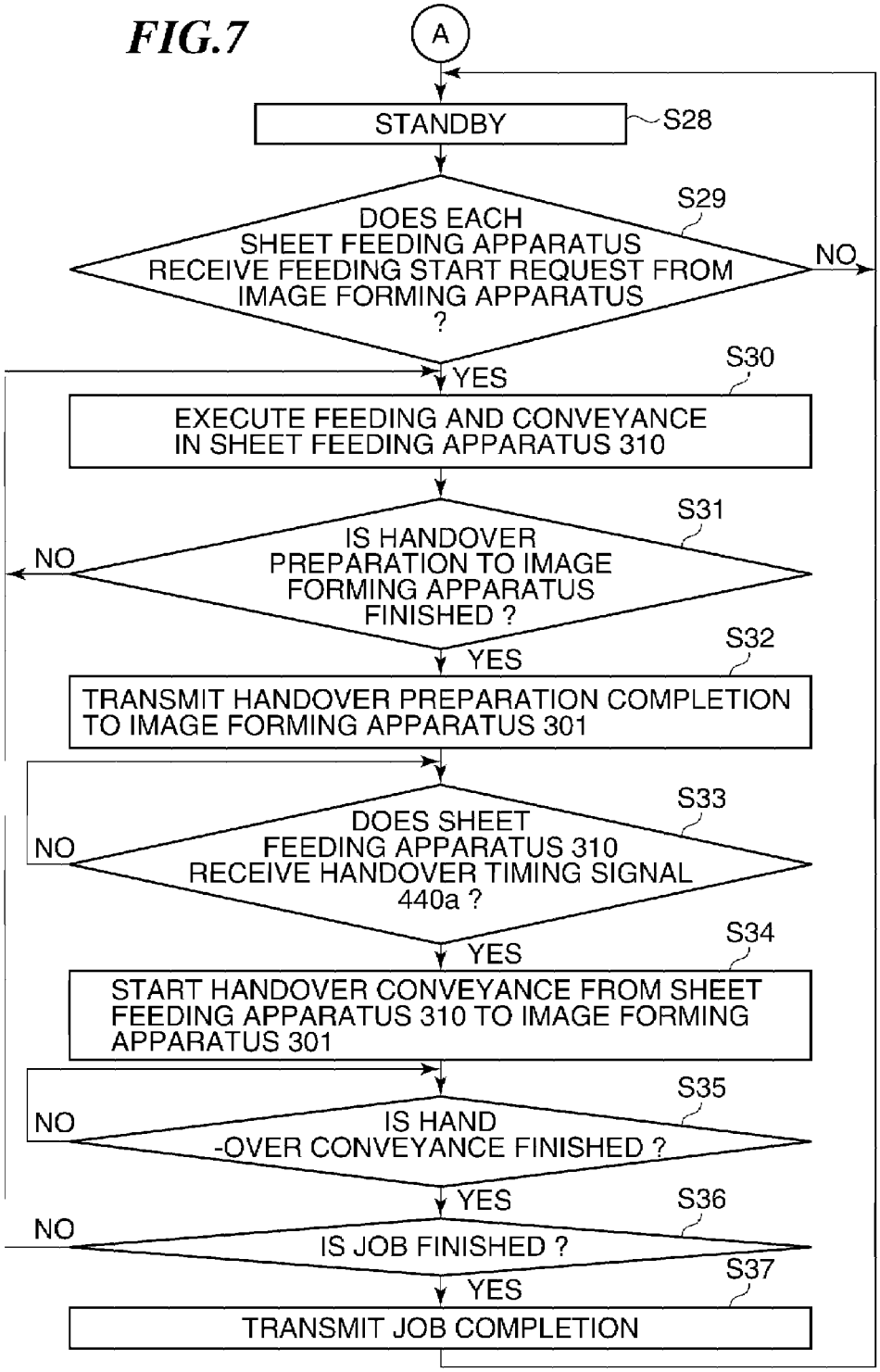
FIG. 7 is a flowchart showing the operational procedures of the sheet feeding apparatus for feeding sheets to the image forming apparatus and for handing over and conveying sheets between the apparatuses.

FIG. 6 and FIG. 7 are flowcharts showing operational procedures of the sheet feeding apparatus 310 for feeding sheets to the image forming apparatus 301 and for handing over and conveying sheets between the apparatuses. This processing program is stored in a storage medium in the feeding control unit 410 of the sheet feeding apparatus 310, and is executed by the CPU 411.

After power on, the feeding control unit 410 performs a feeding pre-control such as adjustment of the amount of blown air in each feeding unit, adjustment of a position of a lifter, detection of the remaining number of sheets, and the like (step S21). The feeding control unit 410 determines whether an abnormality such as alarm or error occurs in the apparatus by comparing each sensor signal, analog values, and the like with predetermined values (step S22).

When an abnormality occurs, the feeding control unit 410 determines whether the abnormality including only the alarm occurs (step S23). When only the alarm occurs, the feeding control unit 410 stops an electric power supplied to the feeding unit concerned and turns off the feeding unit to prohibit the use of the feeding unit (step S25). Then, the feeding control unit 410 transmits alarm information to the image forming apparatus 301 via the bus 450 (step S26).

When an error is found in step S23, the feeding control unit 410 transmits error information via the bus 450, performs a corresponding control according to the error, and stops the processing (step S24). Thereafter, the feeding control unit 410 terminates this processing. Further, after this, the feeding control unit 410 does not accept the feeding control unless an error recovery condition such as resetting of power is satisfied.

After the alarm information is transmitted in step S26, or when an abnormality does not occur in step S22, the feeding control unit 410 transmits other information about the feeding unit (whether there is any sheet, the remaining number of sheets, and status information) via the bus 450 (step S27).

The feeding control unit 410 maintains a standby state (step S28). Then, the feeding control unit 410 maintains the standby state until receiving the feeding start request from the image forming apparatus 301 via the bus 450 (step S29). When receiving the feeding start request in step S29, the feeding control unit 410 feeds and conveys sheets from the specified feeding units while the feeding control unit 410 exchanges data with each of the sheet feeding apparatuses via the serial bus in the order of the specified feeding units and the page ID (step S30).

The feeding control unit 410 determines whether the handover preparation for passing sheets to the image forming apparatus 301 is finished (step S31). The handover preparation completion means that the first sheet fed and conveyed reaches the position of pre-registration A at the most downstream of the sheet feeding apparatus 310, and at that occasion, the conveyance of each of the subsequent sheets on upstream is stopped at the position of the respective pre-registration, so that the sheets are standing by in the order of page ID.

When the handover preparation is finished, the feeding control unit 410 transmits the handover preparation completion to the image forming apparatus 301 via the bus 450 (step S32).

The handover and conveyance control between the image forming apparatus 301 and the sheet feeding apparatus 310 in steps S31 and S32 will be hereinafter described using an exemplary job.

As an example, a case where the page IDs are set as follows will be explained: a first page (P1) is fed from the feeding unit 311; a second page (P2) is fed from the feeding unit 321; a third page (P3) is fed from the feeding unit 331; a fourth page (P4) is fed from the feeding unit 312; a fifth page (P5) is fed from the feeding unit 322; and a sixth page (P6) is fed from the feeding unit 332. The sequence including these six pages as one job will be hereinafter explained.

The sheet P1 is the first sheet of the page ID. Therefore, the sheet P1 is fed from the feeding unit 311 of the sheet feeding apparatus 310, goes through the pre-registrations C and B, is conveyed to the position of the pre-registration A, and is kept waiting there. At the same time, the sheet P4 is fed from the feeding unit 312 of the sheet feeding apparatus 310. The sheets P2 and P5 are fed from the feeding units 321 and 322, respectively, of the sheet feeding apparatus 320. The sheets P3 and P6 are fed from the feeding units 331 and 332, respectively, of the sheet feeding apparatus 330.

Further, the sheet P4 is kept waiting at the pre-registration D. The sheet P2 goes through pre-registrations H and G and is kept waiting at the pre-registration F. The sheet P5 is kept waiting at a pre-registration I. The sheet P3 goes through pre-registrations M and L and is kept waiting at the pre-registration K. Since the sheet P6 is the last sheet, the sheet PC goes through pre-registration N and is kept waiting at the pre-registration L.

As soon as the first sheet P1 reaches the pre-registration A and the sheet P2 and subsequent sheets are waiting at the positions of the pre-registrations upstream of the pre-registration B, the feeding control unit 410 determines that the handover preparation is finished in step S31.

The feeding control unit 410 notifies the handover preparation completion to the image forming apparatus 301 via the bus 450 (step S32). In step S9, the image forming control unit 401 receives the handover preparation completion from the feeding control unit 410, and thereafter, in step S10, the image forming control unit 401 transmits the handover timing signal 440*a* at an arbitrary timing.

The feeding control unit 410 waits until receiving (detecting) the handover timing signal 440*a* (step S33). When receiving the handover timing signal 440*a*, the feeding control unit 410 passes and conveys the first sheet P1 kept waiting at the pre-registration A on the conveyance path to the image forming apparatus 301, using this reception as the starting point (step S34).

At this occasion, the sheet conveyance speed of the joined conveyance unit 319 in the sheet feeding apparatus 310 is a conveyance speed X, which is the same as the conveyance speed in the image forming apparatus 301. The sheets other than the first sheet P1 are still kept waiting at the respective pre-registration positions.

After the image forming control unit 401 transmits the handover timing signal 440*a*, the image forming control unit 401 also instructs the conveyance unit 409 to start the conveyance control in order to receive the sheet (the first sheet)

P1 from the sheet feeding apparatus 310. Then, the conveyance unit 409 performs a receiving and conveyance control.

The feeding control unit 410 waits until the rear end of the sheet P1 goes through the most downstream conveyance sensor in the joined conveyance unit 319 of the sheet feeding apparatus 310 and the handover and conveyance is finished (step S35).

After the handover and conveyance is finished, the feeding control unit 410 determines whether the sheet is the last sheet indicating the job completion (step S36). When the feeding control unit 410 determines that the sheet is not the last sheet of the job completion, the feeding control unit 410 causes the operation to return back to the processing of step S30, so that the subsequent sheet P2 waiting at the pre-registration B is conveyed, and is caused to wait at the position of the pre-registration A downstream thereof again.

Similarly, the feeding control unit 410 conveys the sheet P3 and subsequent sheets kept waiting at the positions of the pre-registrations in accordance with the page ID, and causes the sheet P3 and the subsequent sheets to wait at the positions of the pre-registrations downstream by one pre-registration again. At this occasion, the sheet conveyance is performed at a conveyance speed Y faster than the conveyance speed X. The feeding control unit 410 notifies to the image forming apparatus 301 via the bus 450 that the handover preparation is finished again.

The feeding control unit 410 repeatedly performs the processings of step S30 to step S36 until the job is finished. The feeding control unit 410 feeds and conveys the specified number of sheets, and when the sheets have been passed to the image forming apparatus 301, the feeding control unit 410 transmits the job completion to the image forming control unit 401 (step S37). After the transmission, the feeding control unit 410 goes into the above-described standby state in step S28 to wait until receiving the feeding start request again.

Figure 8:
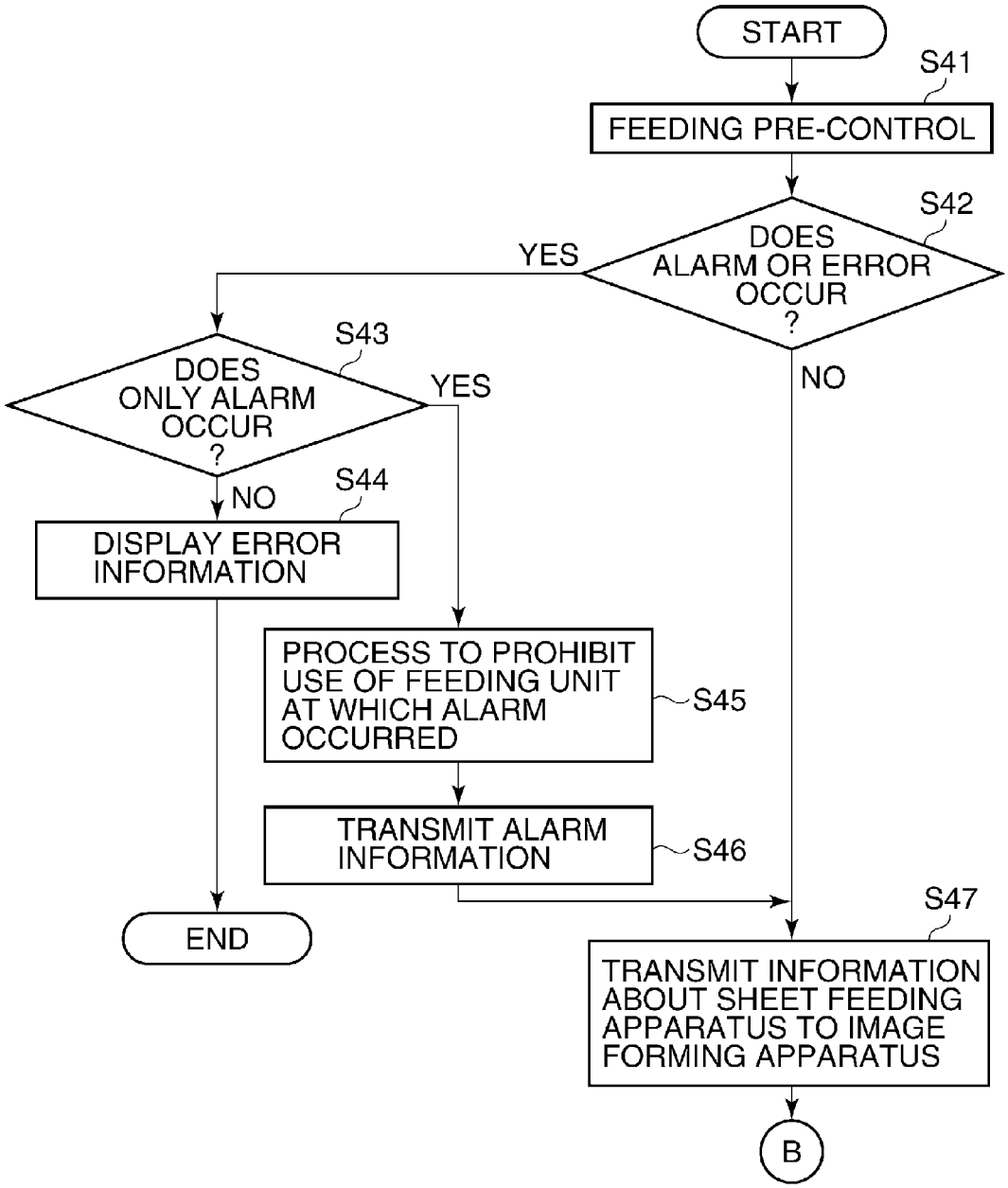
FIG. 8 is a flowchart showing operational procedures of a sheet handover and conveyance control of the sheet feeding apparatuses.
Figure 9:
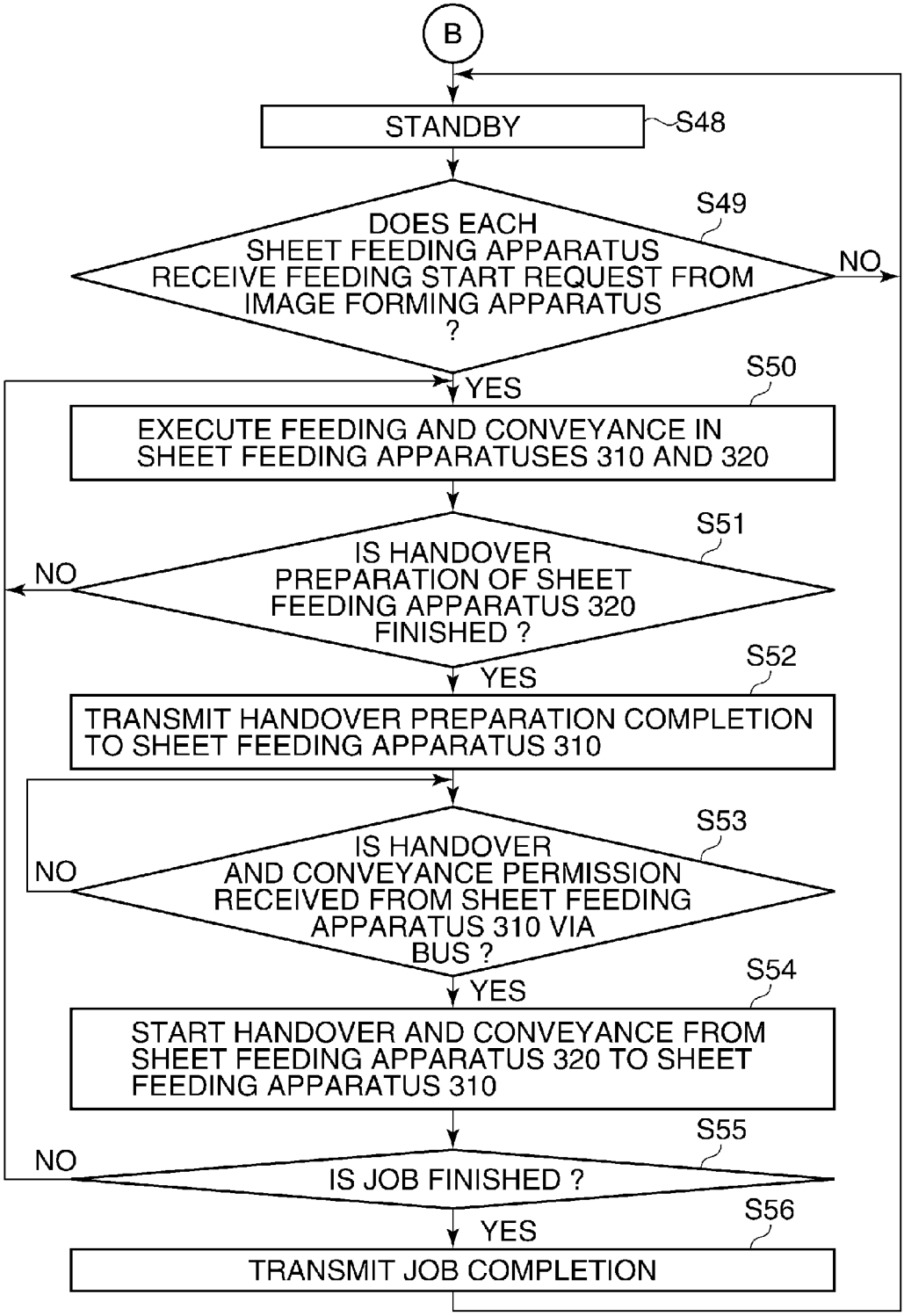
FIG. 9 is a flowchart showing the operational procedures of the sheet handover and conveyance control of the sheet feeding apparatuses.

FIG. 8 and FIG. 9 are flowcharts showing operational procedures of the sheet handover and conveyance control between the sheet feeding apparatuses 310 and 320. This processing program is stored in a storage medium in a feeding control unit 420 of the sheet feeding apparatus 320, and is executed by a CPU 421.

The processings from step S41 to S49 are the same as the processings from step S21 to S29 of FIG. 6 in the operation during the handover and conveyance between the image forming apparatus 301 and the sheet feeding apparatus 310, and therefore, the description thereabout is omitted.

When receiving the feeding start request from the image forming apparatus 301 in step S49, the feeding control unit 420 executes the feeding and conveyance control from the feeding unit concerned (step S50). Similarly, the feeding control unit 410 executes the feeding and conveyance control from the feeding unit concerned.

The above exemplary job will be considered in the same manner. The sheet feeding apparatus 310 feeds and conveys the sheet P1 from the feeding unit 311 to the position of the pre-registration A, and feeds and conveys the sheet P4 from the feeding unit 312 to the position of the pre-registration D. Similarly, the sheet feeding apparatus 320 feeds the sheet P2 from the feeding unit 321, causes the sheet P2 to go through the pre-registrations H and G, and conveys the sheet P2 to the position of the pre-registration F. The sheet feeding apparatus 320 feeds and conveys the sheet P5 from the feeding unit 322 to the position of the pre-registration I. In this state, a sheet corresponding to the first sheet according to the page ID has reached the last pre-registration F in the sheet feeding apparatus 320. The feeding control unit 420 repeats the processing of step S50 until this state is obtained, namely, until the sheet feeding apparatus 320 becomes ready to pass sheets to the sheet feeding apparatus 310 (the handover preparation is finished)(step S51).

When the handover preparation is finished, the feeding control unit 420 notifies the handover preparation completion to the sheet feeding apparatus 310 via the bus (step S52). When receiving the handover preparation completion from the sheet feeding apparatus 320, the sheet feeding apparatus 310 checks the state of the sheet feeding apparatus 310 itself. At this moment, if the sheet feeding apparatus 310 is passing and conveying sheets to the image forming apparatus 301, the sheet feeding apparatus 310 is controlling the conveyance at the conveyance speed X, as described above. Therefore, it is necessary for the sheet feeding apparatus 310 to cause the other sheets to wait at the positions of the pre-registrations, respectively, and therefore, the sheet feeding apparatus 310 transmits a handover and conveyance permission to the sheet feeding apparatus 320. Further, as soon as the sheet feeding apparatus 310 finish passing and conveying the sheets to the image forming apparatus 301, the sheet feeding apparatus 310 can perform conveyance and control at the conveyance speed Y. Therefore, the sheet feeding apparatus 310 transmits the handover and conveyance permission to the sheet feeding apparatus 320, performs conveyance control of the connection unit 323 in the sheet feeding apparatus 310 and the joined conveyance unit 319, and prepares for passing sheets from the sheet feeding apparatus 320.

The sheet conveyance speed Y between the sheet feeding apparatuses is configured to be sufficiently faster speed than the conveyance speed X in the image forming apparatus 301. Therefore, when the handover timing signal between the sheet feeding apparatuses is exchanged via the bus 450, a conveyance delay caused by the communication delay and a delay due to stop of conveyance of subsequent sheets can be absorbed. Namely, a timing can be adjusted when a sheet is passed between the sheet feeding apparatuses. In the present embodiment, the conveyance speed has a relationship of $Y=2X$.

The feeding control unit 420 waits until receiving the handover and conveyance permission from the sheet feeding apparatus 310 via the bus 450 (step S53). When receiving the handover and conveyance permission, the feeding control unit 420 passes and conveys the sheet P2 from the pre-registration F to the connection unit 323, causes the sheet P2 to go through a pre-registration E, and conveys the sheet P2 to the pre-registration B via the lower conveyance unit 318 and the joined conveyance unit 319 (step S54). The feeding control unit 420 does not keep the sheet P2 waiting at the pre-registration E, but causes the conveyance to continue. As described above, this is because the preceding sheet had already gone through the pre-registration B. It should be noted that, when the preceding sheet is at the pre-registration B, the sheet P2 is controlled to wait at the pre-registration E. Normally, the handover and conveyance from the pre-registration F to the pre-registration E corresponds to the handover and conveyance control between the sheet feeding apparatuses 310 and 320 in step S54.

Thereafter, the feeding control unit 420 determines whether the job is finished (step S55). When the sheet P2 is conveyed from the pre-registration F, and the sheet P2 is the last sheet of the job, the job is determined to have finished. When the job is not yet finished, the feeding control unit 420 causes the operation to return back to the processing of step S50.

When the job is determined to have finished, the feeding control unit 420 transmits to the image forming apparatus 301 via the bus 450 that the job has been finished (step S56).

Thereafter, the feeding control unit 420 causes the operation to return back to step S48 and proceed to standby state. When the sheet P2 is not the last sheet, the feeding control unit 420 performs a conveyance control to convey a subsequent sheet at the conveyance speed Y to the position of the predetermined downstream pre-registration in step S50 at the same time as the handover and conveyance. In this way, until the job is determined to have finished, the series of controls from step S50 to step S55 are repeatedly performed.

It should be noted that although a handover and conveyance control between the sheet feeding apparatuses, i.e., between the sheet feeding apparatus 310 and the sheet feeding apparatus 320 is assumed the same control is performed in a handover and conveyance control further upstream between the sheet feeding apparatus 320 and the sheet feeding apparatus 330. The description thereabout is omitted.

As described above, in the image forming system according to the first embodiment, the sheet conveyance control causes a sheet to wait at the position of the pre-registration A of the sheet feeding apparatus 310, and accordingly the sheet handover preparation is finished. Thereafter, the sheet feeding apparatus 310 conveys the sheet to the image forming apparatus 301 upon receiving the handover timing signal 440*a* from the handover timing signal line 440. As a result, a timing of sheet conveyance between the image forming apparatus and the sheet feeding apparatus can be controlled with high precision. Therefore, a decrease of productivity, a jam, and a positional shift of an image due to a shift in conveyance timing do not occur. As a result, the sheets can be fed with a shorter sheet interval therebetween. Further, the image forming system according to the first embodiment does not increase the number of signal lines, and can be configured easily with only a harness, thus improving the reliability of the apparatus, providing ease of maintenance, and reducing the cost. Further, even when a plurality of sheet feeding apparatuses are connected to the image forming apparatus, the same advantages can be obtained by controlling only a timing of conveyance to the sheet feeding apparatus arranged immediately upstream thereof.

Further, the serial bus cable (the bus 450) allowing cascade connection between the apparatuses and a harness carrying a timing signal for conveyance to the sheet feeding apparatus immediately upstream of the image forming apparatus (the handover timing signal line 440) are arranged between the image forming apparatus and the plurality of sheet feeding apparatuses. The image forming system according to the first embodiment is simply configured in this way, and accordingly, is effective for improving ease of maintenance and the reliability of the apparatus and for reducing the cost.

Further, a sheet waiting at the position of the pre-registration A of the sheet feeding apparatus is conveyed to the image forming apparatus, so that the sheet can be smoothly conveyed between the apparatuses. Further, the plurality of sheet feeding apparatuses start and stop feeding of sheets, and the sheets are conveyed between the plurality of sheet feeding apparatuses, so that subsequent sheets can be continuously fed from sheet feeding apparatuses other than the one immediately upstream of the image forming apparatus.

Further, the sheet conveyance speed is changed when the sheets are conveyed between the plurality of sheet feeding apparatuses, and therefore, a conveyance delay due to communication delay and a delay caused by stopping of conveyance of a subsequent sheet can be absorbed when the sheets are conveyed via the bus.

Further, each of the image forming control unit and the feeding control unit has its own CPU, and therefore, feeding of sheets can be controlled in an easy and freely changeable manner. In addition, since a general-purpose serial bus is used, the system can be easily realized.

It should be noted that in the above embodiment, the timing of sheet conveyance from the sheet feeding apparatus 310 to the image forming apparatus 301 is decided based on the handover timing signal 440*a* as the starting point, but this timing may be decided as follows: the image forming control unit 401 transmits a sheet handover command to the feeding control unit 410 via the bus 450. Then, when the feeding control unit 410 receives one of the handover timing signal 440*a* and the sheet handover command, whichever is received earlier, the sheet handover timing may be decided based on the preceding signal as a starting point. Therefore, even when a delay occurs in the handover timing signal 440*a* due to an abnormality of some sort, the productivity in the sheet handover is prevented from decreasing. Further, the sheet handover can be performed fast.

The configuration of an image forming system according to the second embodiment is the same as that of the first embodiment, and accordingly, the description thereabout is omitted by using the same reference numerals. The second embodiment is different from the first embodiment in that a determination is made as to whether there is any abnormality of the handover timing signal 440*a*.

Figure 10:
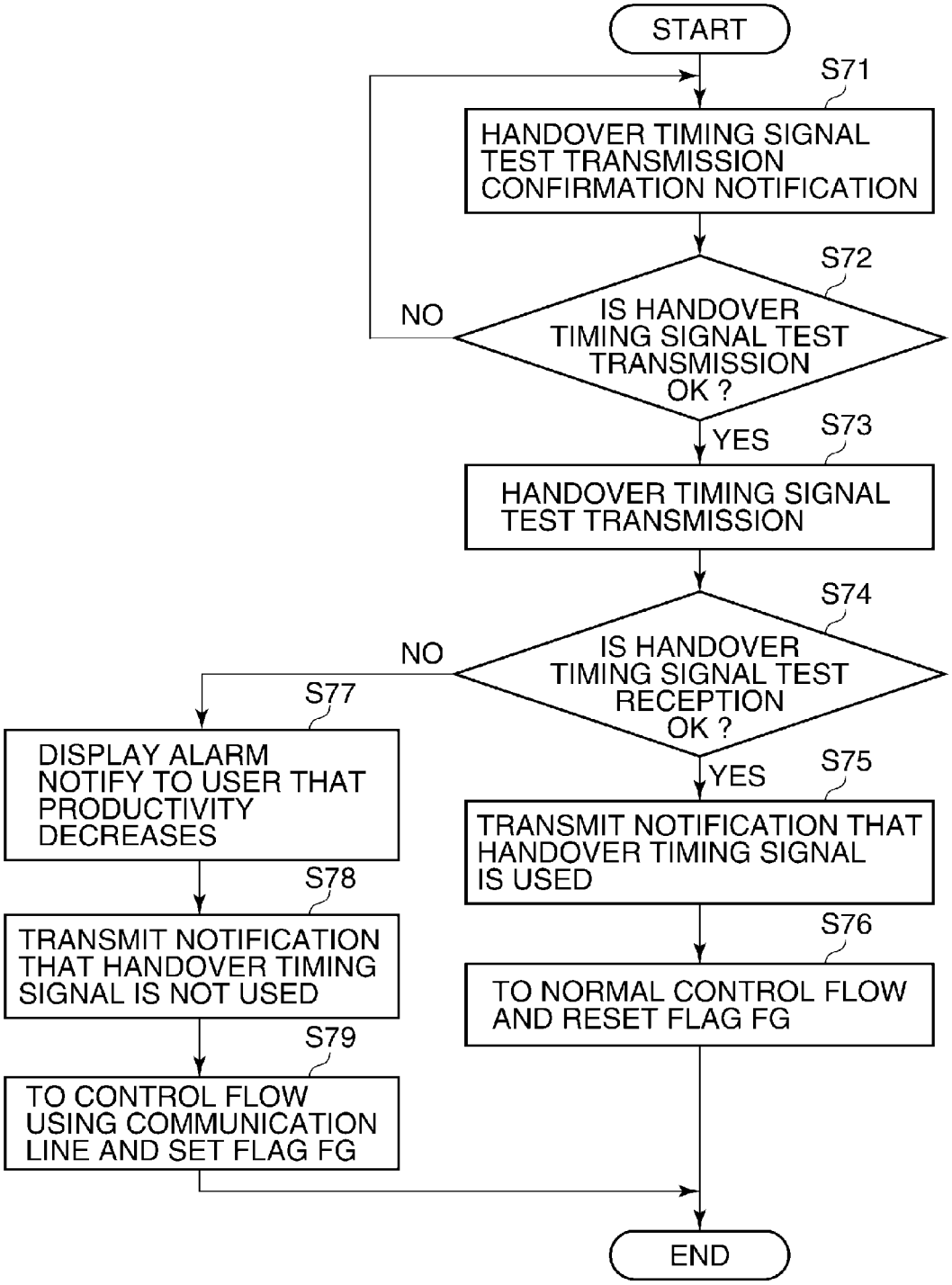
FIG. 10 is a flowchart showing abnormality determination procedures of an image forming control unit for determining an abnormality of a handover timing signal between the image forming control unit and a feeding control unit.

FIG. 10 is a flowchart showing abnormality determination procedures of the image forming control unit 401 for determining an abnormality of the handover timing signal 440*a* between the image forming control unit 401 and the feeding control unit 410. This processing program is stored in a storage medium in the image forming control unit 401, and is executed by the CPU 403. Further, after the image forming apparatus 301 is turned on, this processing is performed as one of the initial controls performed between the image forming apparatus 301 and the sheet feeding apparatus 310 immediately upstream thereof.

The image forming control unit 401 in the image forming apparatus 301 notifies to the feeding control unit 410 in the sheet feeding apparatus 310 via the bus 450 that a test transmission of the handover timing signal 440*a* is to be performed (step S71).

The image forming control unit 401 repeatedly performs the processing in step S71 to periodically performs the above notification until receiving ready-for-transmission from the feeding control unit 410 (step S72). Then, when receiving the ready-for-transmission, the image forming control unit 401 performs the test transmission of the handover timing signal 440*a* via the handover timing signal line 440 arranged separately from the bus 450 (step S73).

After the test transmission, the image forming control unit 401 checks whether the feeding control unit 410 has normally received the test transmission of the handover timing signal 440*a* (step S74). When receiving via the bus 450 a confirmation that the test transmission has been normally received, the image forming control unit 401 performs transmission as follows (step S75). Specifically, the image forming control unit 401 transmits to the sheet feeding apparatus 310 immediately upstream thereof via the bus 450 a notification that the sheet handover and conveyance between the image forming apparatus 301 and the sheet feeding apparatus 310 immediately upstream thereof is to be performed under a normal control using the handover timing signal 440*a*.

The image forming control unit 401 causes a flag FG in the CPU 403 to remain reset in order to perform the handover and conveyance control under the normal control of FIG. 5 described above (step S76). It should be noted that this flag FG is reset in an initial state. Thereafter, the image forming control unit 401 terminates this processing. Then, the handover and conveyance control under the normal control of FIG. 5 described above is performed.

When the result of the test reception is determined to be abnormal in step S74, the image forming control unit 401 transmits an alarm code indicating an occurrence of abnormality to the handover timing signal 440*a*, and causes the operation unit 302 to display a notification to the effect that the productivity decreases due to the occurrence of the alarm (step S77). It should be noted that instead of displaying the notification on the operation unit 302, the notification may be displayed on a printer driver connected to the network. It should be noted that the processings in steps S73, S74 and S77 or the processings in later-described steps S86, S87, S91 and S92 are an example of an abnormality detection unit.

After the notification to the user, the image forming control unit 401 notifies via the bus 450 to the sheet feeding apparatus 310 immediately upstream of the image forming apparatus 301 that the handover and conveyance is controlled under a mode using the bus, in which the handover timing signal 440*a* is not used (step S78).

Then, the image forming control unit 401 sets the flag F in order to perform the handover and conveyance control under the control using the bus of FIG. 13 described later (step S79). Thereafter, the image forming control unit 401 terminates this processing.

Figure 11:
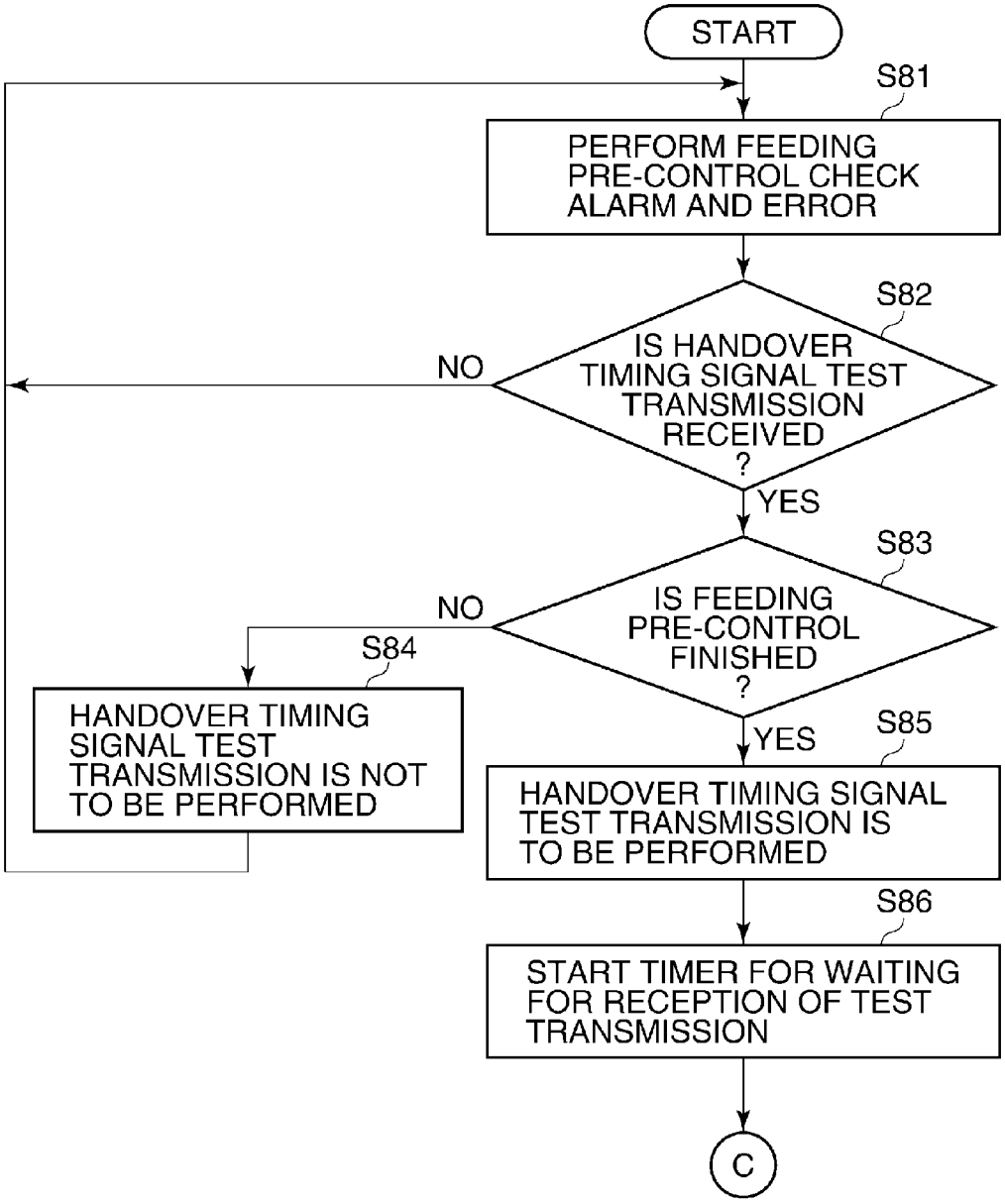
FIG. 11 is a flowchart showing abnormality determination procedures of the feeding control unit for determining an abnormality of the handover timing signal between the image forming control unit and the feeding control unit.
Figure 12:
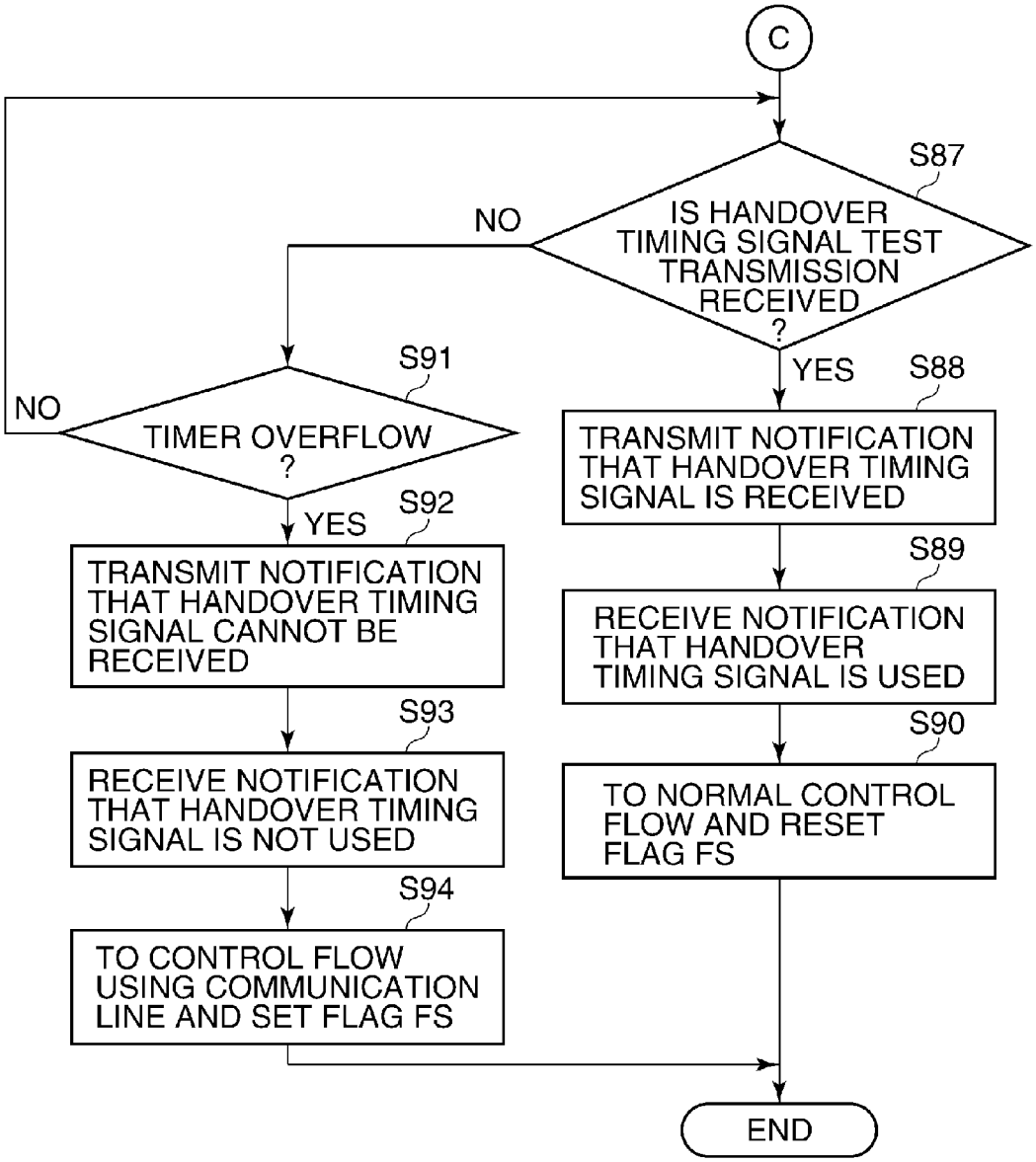
FIG. 12 is a flowchart showing the abnormality determination procedures of the feeding control unit for determining an abnormality of the handover timing signal between the image forming control unit and the feeding control unit.

FIG. 11 and FIG. 12 are flowcharts showing abnormality determination procedures of the feeding control unit 410 for determining an abnormality of the handover timing signal 440*a* between the image forming control unit 401 and the feeding control unit 410. This processing program corresponds to FIG. 10 and is stored in a storage medium in the feeding control unit 410, and is executed by the CPU 411.

After the sheet feeding apparatus 310 is turned on, the feeding control unit 410 performs, as an initial control, a feeding pre-control such as adjustment of the amount of blown air in each feeding unit, adjustment of the position of a lifter, detection of the remaining number of sheets, and the like (step S81). Further, the feeding control unit 410 checks whether an abnormality such as alarm and error occurs in the apparatus or not in step S81. It should be noted that the processing of step S81 is the same as the processing of step S21 described above.

The feeding control unit 410 periodically checks, as one of the initial controls, the test transmission of the handover timing signal 440*a* transmitted from the image forming control unit 401, and determines whether the feeding control unit 410 receives the test transmission or not (step S82). When not receiving the test transmission, the feeding control unit 410 causes the operation to return back to the processing in step S81, and continues the initial control.

When receiving the test transmission, the feeding control unit 410 determines whether the initial control is finished or not (step S83). When the initial control is not finished, the feeding control unit 410 notifies to the image forming control unit 401 that the feeding control unit 410 is not ready to receive the test transmission and instructs the image forming control unit 401 to wait to transmit the test transmission of the handover timing signal 440*a* until the initial processing is finished (step S84). Thereafter, the feeding control unit 410 causes the operation to return back to the processing in step S81.

When the initial processing is finished in step S84, the feeding control unit 410 notifies to the image forming control unit 401 that the feeding control unit 410 is ready to receive the test transmission of the handover timing signal 440*a* (step S85). Then, the feeding control unit 410 starts a timer for waiting for the reception of the test transmission (step S86).

The feeding control unit 410 determines whether having received the test transmission of the handover timing signal 440*a* via the handover timing signal line 440 (step S87). When normally detecting the reception of the test transmission of the handover timing signal 440*a*, the feeding control unit 410 notifies to the image forming control unit 401 via the bus 450 that the feeding control unit 410 has normally received the handover timing signal 440*a* (step S88).

The feeding control unit 410 notifies, via the bus 450, to the image forming control unit 401 having received the normal reception notification, that the sheet handover and conveyance control between the image forming apparatus 301 and the sheet feeding apparatus 310 immediately upstream thereof is performed under the normal control using the handover timing signal 440*a* (step S89).

The feeding control unit 410 causes the flag FS in the CPU 411 to remain reset in order to perform the sheet handover and conveyance control under the normal control of FIG. 6 and FIG. 7 described above (step S90). It should be noted that the flag FS is reset in the initial state. Thereafter, the feeding control unit 410 terminates this processing. Then, the sheet handover and conveyance control is performed under the normal control of FIG. 6 and FIG. 7 described above.

When the feeding control unit 410 does not normally detect the handover timing signal 440*a* in step S87, the feeding control unit 410 determines whether the timer for waiting for the reception of the test transmission is less than a predetermined count value (step S91). When the timer is less than the predetermined count value, the feeding control unit 410 causes the operation to return back to the processing in step S87, and waits for the normal detection again. When the timer for waiting for the reception of the test transmission is more than the predetermined count value but the feeding control unit 410 fails to receive the test signal, the feeding control unit 410 results in a timer overflow. In this case, a certain abnormality should have occurred in the handover timing signal line 440, and therefore, the feeding control unit 410 notifies via the bus 450 to the image forming control unit 401 that the feeding control unit 410 cannot detect the test transmission (step S92).

Accordingly, the image forming control unit 401 receives from the feeding control unit 410 the notification that the feeding control unit 410 cannot detect the test transmission. Then, the feeding control unit 410 receives via the bus 450 from the image forming control unit 401 a notification that the handover timing signal 440*a* is not used (step S93). Then, the feeding control unit 410 sets the flag FS in order to perform the sheet handover and conveyance control under the control using the bus of FIG. 14 and FIG. 15 described later (step S94). Thereafter, the feeding control unit 410 terminates this processing.

Figure 13:
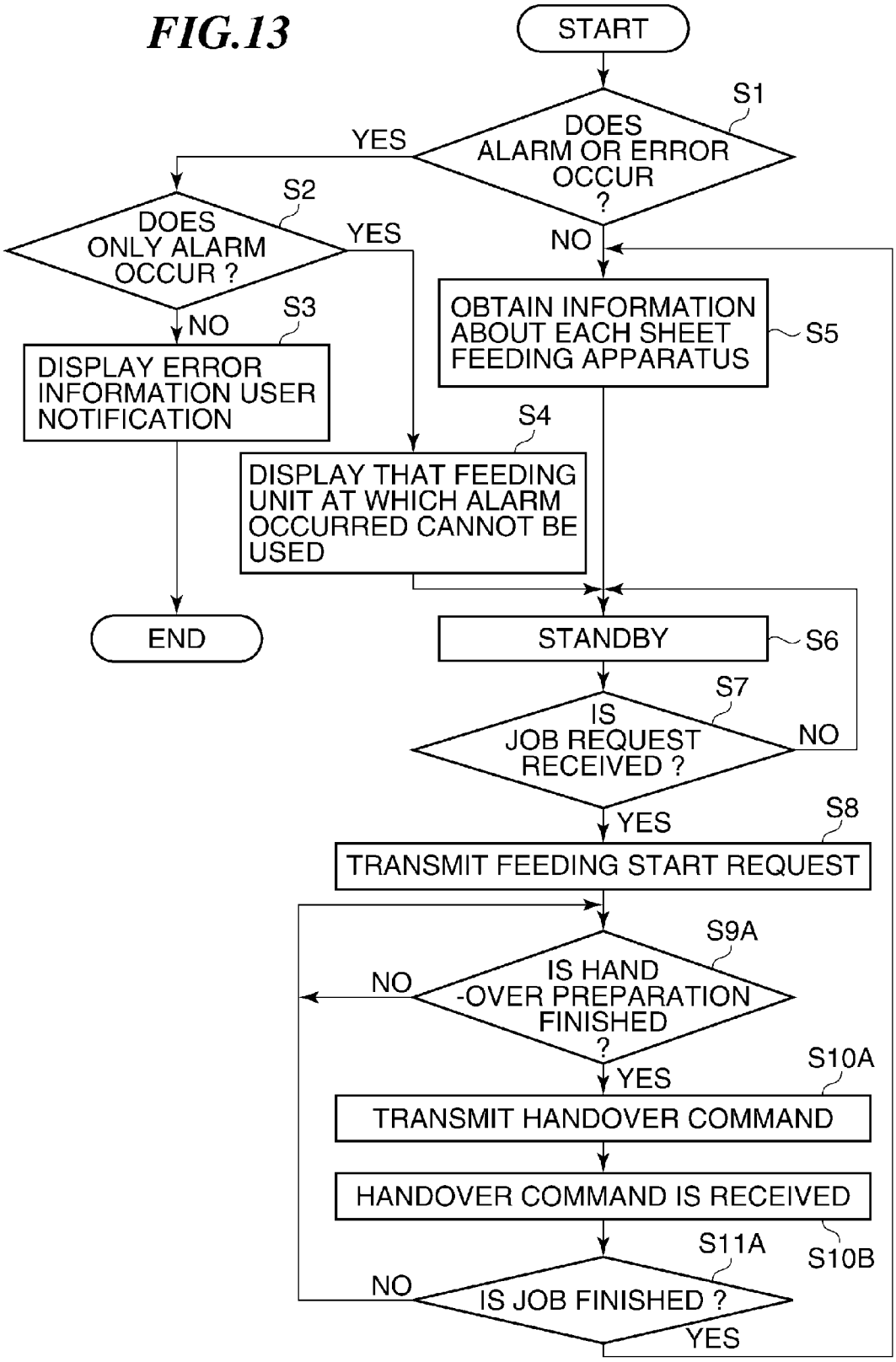
FIG. 13 is a flowchart showing sheet feeding operational procedures of the image forming apparatus for each of the sheet feeding apparatuses when a bus is used since the handover timing signal is determined to be abnormal.

FIG. 13 is a flowchart showing sheet feeding operational procedures of the image forming apparatus 301 for each of the sheet feeding apparatuses when the bus is used since the handover timing signal 440*a* is determined to be abnormal. This processing program is stored in a storage medium in the image forming control unit 401. When the flag FG is set after power-on, this processing program is executed by the CPU 403. It should be noted that the processings from steps S1 to S8 are the same as those of the first embodiment, and therefore, the description thereabout is omitted. Some of the controls from step S8 to step S5 of the above-described normal control performed by the image forming control unit are changed to the control using the bus.

When the feeding start request from the image forming control unit 401 is transmitted to the sheet feeding apparatus 310 immediately upstream of the image forming apparatus 301 in step S8, the sheet feeding apparatus 310 notifies to the image forming control unit 401 via the bus 450 that the sheet feeding apparatus 310 is ready to convey the sheets to the image forming apparatus 301.

The image forming control unit 401 suspends the image forming operation until the image forming control unit 401 receives the sheet handover preparation completion from the sheet feeding apparatus 310 (step S9A). When receiving the sheet handover preparation completion, the image forming control unit 401 transmits a sheet handover command instead of the handover timing signal 440*a* to the sheet feeding apparatus 310 immediately upstream of the image forming apparatus 301 via the bus 450 (step S10A).

The image forming control unit 401 receives from the feeding control unit 410 a notification that the feeding control unit 410 has normally received the sheet handover command, and causes the conveyance unit 409 on the image forming apparatus 301 side to perform a conveyance control for receiving sheets from the sheet feeding apparatus 310 (step S10B).

The image forming control unit 401 determines whether the job is finished (step S11A). When the job is not finished, the processings from step S9A to step S11A are repeated until the job is finished. After the job is finished, the image forming control unit 401 causes the operation to return back to the processing in step S5 just like the normal control.

Figure 14:
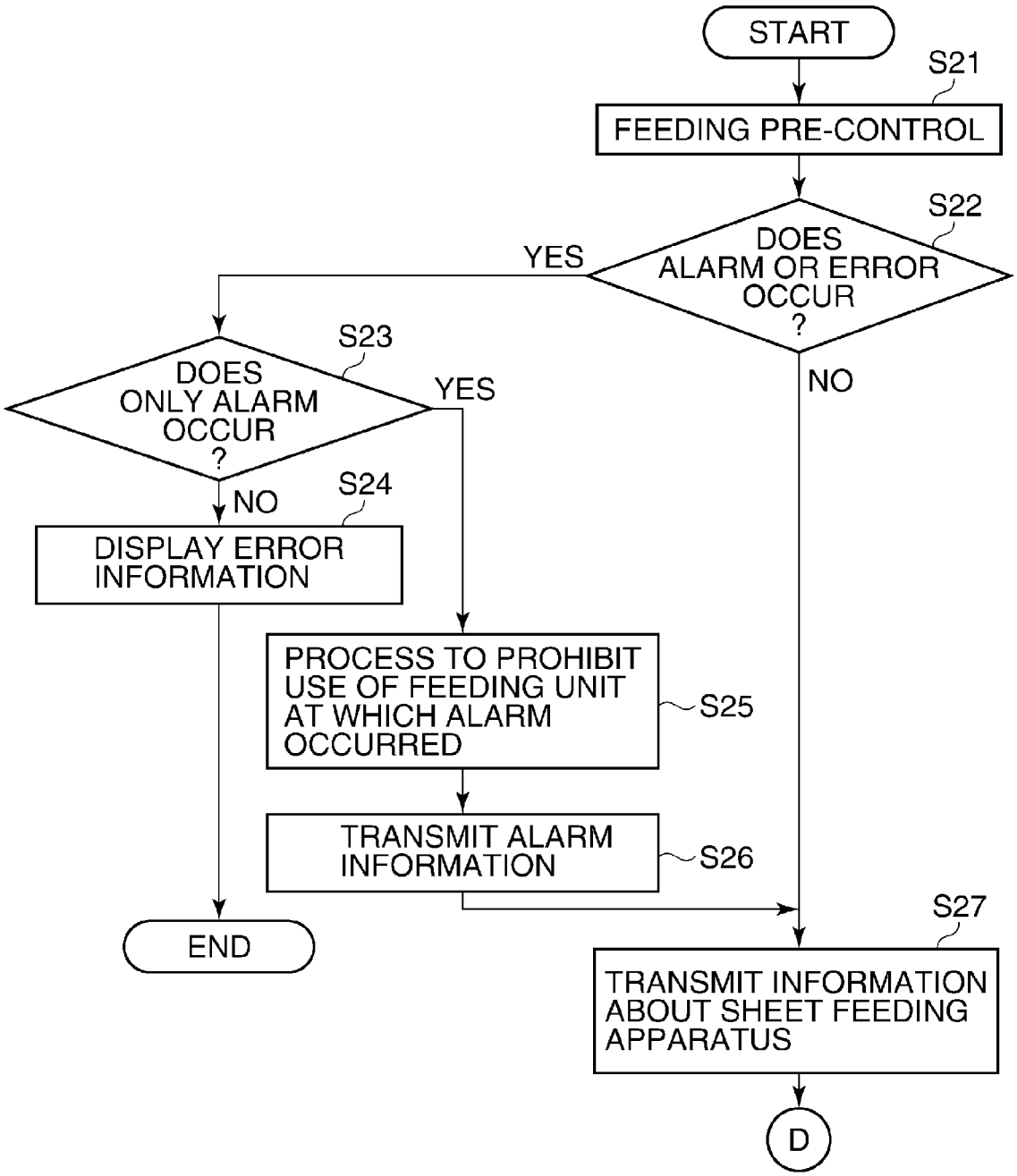
FIG. 14 is a flowchart showing operational procedures of the sheet feeding apparatus for feeding sheets to the image forming apparatus and for handing over and conveying sheets between the apparatuses when the bus is used since the handover timing signal is determined to be abnormal.
Figure 15:
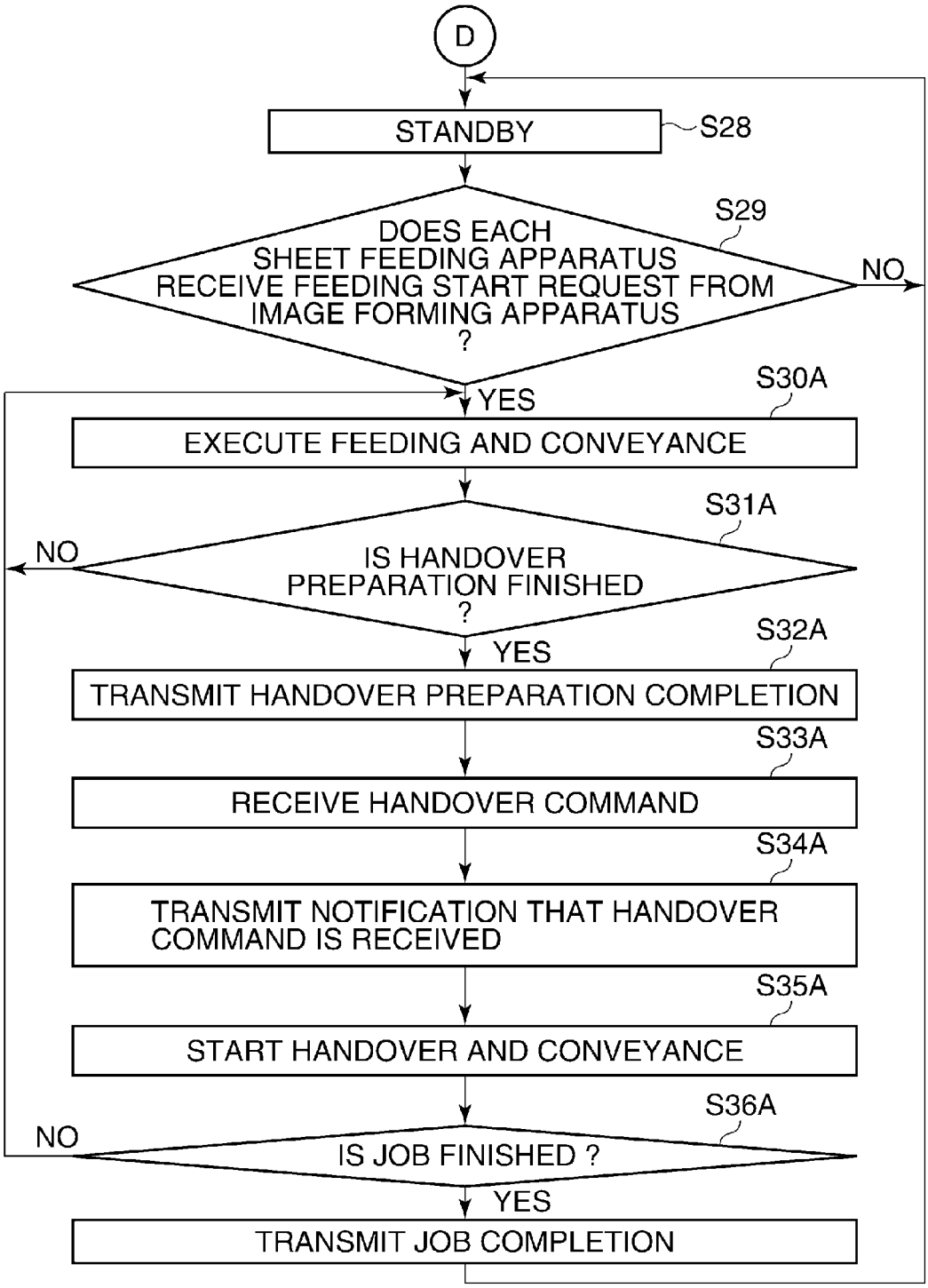
FIG. 15 is a flowchart showing the operational procedures of the sheet feeding apparatus for feeding sheets to the image forming apparatus and for handing over and conveying sheets between the apparatuses when the bus is used since the handover timing signal is determined to be abnormal.

FIG. 14 and FIG. 15 are flowcharts showing operational procedures of the sheet feeding apparatus 310 for feeding sheets to the image forming apparatus 301 and feeding sheets between the apparatuses when the bus is used since the handover timing signal 440*a* is determined to be abnormal. This processing program is stored in a storage medium in the feeding control unit 410 of the sheet feeding apparatus 310. When the flag FS is set, this processing program is executed by the CPU 411. Some of the processings from step S29 to step S36 of the normal control performed by the feeding control unit 410 are changed to the control using the bus.

In step S29, the feeding control unit 410 continues to be in standby state until receiving the feeding start request from the image forming apparatus 301 via the bus 450. When receiving the feeding start request, the feeding control unit 410 feeds and conveys sheets from the specified feeding unit in the order of the specified feeding unit and the page ID while the feeding control unit 410 exchanges data with each of the sheet feeding apparatuses via the serial bus (step S30A).

The feeding control unit 410 waits until a preparation for the sheet handover is finished (step S31A). As soon as the first sheet fed and conveyed reaches the waiting position of the pre-registration A of the sheet feeding apparatus 310 immediately upstream of the image forming apparatus 301, the feeding and conveyance of the subsequent sheets upstream thereof are stopped at the respective waiting positions of the pre-registrations (see FIG. 3). When the first sheet and the subsequent sheets go into standby state in the order of the page ID and are ready to be handed over, the feeding control unit 410 transmits the handover preparation completion to the image forming apparatus 301 via the bus 450 (step S32A). The conveyance control between the sheet feeding apparatuses and the operation of the control up to the handover preparation completion are the same as the processings in steps S31 and S32 described in the normal control according to the first embodiment.

Further, after receiving the handover preparation completion from the feeding control unit 410, the image forming control unit 401 transmits the handover command instead of the handover timing signal 440*a* via the bus 450 at an arbitrary timing. The feeding control unit 410 receives the handover command from the image forming control unit 401 (step S33A). Then, the feeding control unit 410 transmits to the image forming control unit 401 a notification that the feeding control unit 410 has normally received the handover command (step S34A).

At the same time, the feeding control unit 410 performs a handover conveyance for handing over the sheet P1 waiting at the pre-registration A on the conveyance path to the image forming apparatus 301 (step S35A). Thereafter, the feeding control unit 410 repeats the processings of steps S31A to S36A described above until the job is finished (step S36A). The feeding control unit 410 feeds and conveys the specified number of sheets. As soon as the feeding control unit 410 finishes handing over the sheets to the image forming apparatus 301, namely after the job is finished, the feeding control unit 410 causes the operation to proceed to the processing in step S37 just like the normal control.

In the bus control, a larger timing delay caused by communication delay occurs in the handover and conveyance control than that in the normal control. Therefore, a time period in which sheets are not conveyed becomes longer during sheet conveyance, and the bus control cannot achieve a high throughput under a normal sequence. However, the control of the entire system is the same as the control under the normal sequence described above, and therefore, problems such as jam and defective images do not occur.

The image forming system according to the second embodiment achieves the following advantages in addition to the advantages shown in the first embodiment. When the feeding start (handover) timing signal is abnormal, the sheet handover control is performed on the basis of the handover command transmitted via the bus as the starting point, so that the entire system does not stop and a user can continuously use the system. Therefore, a loss caused to the user can be reduced. In this way, when the feeding start (handover) timing signal is abnormal, the sheet conveyance speed is decreased to the level at which the entire system can sustain a conveyance sequence, and an alternative control for the feeding start timing signal is performed via the bus. As a result, since the entire system does not stop and a user can continuously use the system, a loss caused to the user is reduced. Further, it is not necessary to separately arrange an alternative signal, and the existing bus is used, the above advantages can be achieved without increasing the cost.

Namely, even when an abnormality occurs in the feeding conveyance timing signal, the image forming system does not stop and can be continuously used, although there is a possibility that the productivity may decrease.

Further, an occurrence of abnormality of the system can be notified as the alarm to the user so as to allow the user to repair the system at any time. This results in reducing a loss caused to the user. Further, since it is not necessary to separately arrange an alternative signal, and the existing communication connection unit (serial bus) is used, the above advantages can be realized without increasing the cost.

The above embodiments show examples of preferred embodiments of the present invention. The present invention is not limited thereto, and various modifications can be made within a scope not deviating from the subject matter thereof.

For example, in the above embodiments, one image forming apparatus and three sheet feeding apparatuses are connected, but it is to be understood that the number of connected sheet feeding apparatuses is not especially limited. As an example of the image forming system, one sheet feeding apparatus may be connected to one image forming apparatus, which configuration also allows both of the handover timing signal line and the serial bus to be used for sheet conveyance and handover.

It is to be understood that the image forming apparatus may be not only an original printing apparatus but also a facsimile apparatus having a printing function and a multifunction peripheral (MFP) having a printing function, a copy function, a scanner function, and the like.

In the above embodiments, the monochrome image forming apparatus using an intermediate transfer body, transferring a toner image to this intermediate transfer body, and transferring onto a recording medium the toner image carried on this intermediate transfer body is described as an example of image forming apparatus. But a color image forming apparatus may be employed. Further, the transfer method is not limited thereto, and a color image forming apparatus using a recording medium carrier and sequentially transferring toner images in various colors to a recording medium carried by the recording medium carrier in an overlapping manner may be employed.

The shapes and the relative arrangements of constituent parts described in the above embodiment should be changed as necessary in accordance with a configuration and various conditions to which the present invention can be applied, and the scope of the present invention is not limited to the above example.

In the above embodiment, a case where the printing method of the multifunction apparatus is the electrophotographic method is described as an example. But the present invention is not limited to the electrophotographic method, and the present invention may be applied to various printing methods such as an inkjet method, a thermal transfer method, a thermal method, an electrostatic method, and a discharge breakdown method.

Further, the image forming apparatus can be connected to various optional apparatuses for expanding its functions (which are also referred to as accessories or accessory devices) as necessary according to a demand of a user. Example of the optional apparatus includes staple equipment for stapling sheets on which images are formed, a folding apparatus for folding sheets, a sort apparatus for sorting sheets, a punching apparatus for punching holes for binding on sheets, an automatic duplex conveyance apparatus for forming images on both sides of sheets, an inserting apparatus for inserting another sheet between sheets, a cutter apparatus capable of cutting many sheets at a time, an automatic document feeding apparatus for automatically feeding documents to a scanner, and a post-fixing processing apparatus for processing output images at high quality.

Further, sheets are not especially limited, and may include a paper medium, an OHP sheet, a thick sheet of paper, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-238077 filed Sep. 17, 2008, which is hereby incorporated by reference herein in its entirety.

What is claimed is:

1. An image forming apparatus connectable to first and second sheet feeding apparatuses for forming an image on a sheet fed by said first sheet feeding apparatus, wherein said first sheet feeding apparatus feeds the sheet to said image forming apparatus, and said second sheet feeding apparatus feeds the sheet to said first sheet feeding apparatus, said image forming apparatus comprising:

a transmission path adapted to connect said image forming apparatus and said first and second sheet feeding apparatuses, said transmission path transmitting information among said image forming apparatus and said first and second sheet feeding apparatuses, wherein said transmission path is comprised of a serial bus;

a signal line adapted to connect said image forming apparatus and said first sheet feeding apparatus, said signal line transmitting a handover signal output from said image forming apparatus to said first sheet feeding apparatus, and a first control unit adapted to transmit a feeding start request to said first and second sheet feeding apparatuses via said transmission path, and transmit the handover signal to said first sheet feeding apparatus via said signal line after receiving a preparation-completion notification corresponding to the feeding start request from said first sheet feeding apparatus, wherein said first sheet feeding apparatus includes a conveyance unit and a second control unit, said conveyance unit adapted to convey a sheet to a predetermined position of said conveyance unit as a temporary sheet waiting position in accordance with a reception of the feeding start request via said transmission path, and convey the sheet at the predetermined position to said image forming apparatus in accordance with a reception of the handover signal via said signal line, wherein a first speed at which the sheet is conveyed to the predetermined position is faster than a second speed at which the sheet is conveyed from the predetermined position to said image forming apparatus, and said second control unit adapted to transmit the preparation-completion notification to said image forming apparatus after said conveyance unit conveys the sheet to the predetermined position;

wherein the second control unit communicates with said second sheet feeding apparatus via said transmission path to receive the sheet from said second sheet feeding apparatus, and wherein said signal line is disposed such that said first sheet feeding apparatus does not communicate with said second sheet feeding apparatus via said signal line, to receive the sheet from said second sheet feeding apparatus.

2. The image forming apparatus according to claim 1 further comprising:

an abnormality detection unit adapted to detect an abnormality of the handover signal, wherein, when said abnormality detection unit detects the abnormality of the signal, the first control unit transmits a handover command via said transmission path after the first control unit transmits the feeding start request to said first sheet feeding apparatus via said transmission path.

3. The image forming apparatus according to claim 2, wherein the first control unit transmits the handover signal to said sheet feeding apparatus via said signal line and transmits the handover command to said sheet feeding apparatus via said transmission path, and, when the second control unit receives one of the handover signal and the handover command, the second control unit controls said sheet feeding apparatus to convey the sheet at the predetermined position to said image forming apparatus.

4. An image forming system including an image forming apparatus for forming an image on a sheet, a first sheet feeding apparatus for directly feeding the sheet to said image forming apparatus, and a second sheet feeding apparatus for feeding the sheet to said image forming apparatus via said first sheet feeding apparatus, the image forming system comprising:

a transmission path adapted to connect said image forming apparatus and said first and second sheet feeding apparatuses, said transmission path transmitting information among said image forming apparatus and said first and second sheet feeding apparatuses, wherein said transmission path is comprised of a serial bus; and a signal line adapted to connect said image forming apparatus and said first sheet feeding apparatus, said signal line transmitting a handover signal output from said image forming apparatus to said first sheet feeding apparatus, wherein said image forming apparatus has a first control unit for transmitting a feeding start request to said first and second sheet feeding apparatuses via said transmission path, and transmitting the handover signal to said first sheet feeding apparatus via said signal line after receiving a preparation-completion notification corresponding to the feeding start request from said first sheet feeding apparatus, wherein said first sheet feeding apparatus includes a first feeding unit arranged with a first container for storing a bundle of sheets, a first conveyance unit adapted to convey the sheet fed by said first sheet feeding unit to said image forming apparatus, and a second control unit adapted to control said first sheet feeding unit and said conveyance unit, wherein the fed sheet is conveyed to a first predetermined position of said first conveyance unit as a temporary sheet waiting position in accordance with a reception of the feeding start request via said transmission path, wherein the sheet at the first predetermined position is conveyed to said image forming apparatus in accordance with a reception of the handover signal via said signal line, wherein a first speed at which the sheet is conveyed to the predetermined position is faster than a second speed at which the sheet is conveyed from the predetermined position to said image forming apparatus, wherein the second control unit transmits the preparation-completion notification to said image forming apparatus after the sheet is conveyed to the predetermined position;

wherein said second sheet feeding apparatus includes a second feeding unit arranged with a second container for storing a bundle of sheets, a second conveyance unit adapted to convey the sheet fed by said second feeding unit to said first sheet feeding apparatus, and a third control unit adapted to control said second feeding unit and said second conveyance unit, and wherein the sheet fed by said second feeding unit is conveyed to said first sheet feeding apparatus in accordance with a reception of the feeding start request via said transmission path, wherein the second control unit communicates with the third control unit via said transmission path to receive the sheet from said second sheet feeding apparatus, and wherein said signal line is disposed such that said first sheet feeding apparatus does not communicate with said second sheet feeding apparatus via said signal line, to receive the sheet from said second sheet feeding apparatus.

5. The image forming system according to claim 4 further comprising:

an abnormality detection unit adapted to detect an abnormality of the handover signal, wherein, in a case where said abnormality detection unit detects the abnormality of the signal, the first control unit transmits the handover command via said transmission path after the first control unit transmits the feeding start request to said first sheet feeding apparatus via said transmission path.

6. The image forming system according to claim 4, wherein the third control unit controls said second sheet feeding apparatus to convey the sheet to said first sheet feeding apparatus at a faster speed than a speed at which said first sheet feeding apparatus conveys the sheet at the predetermined position to said image forming apparatus.

7. The image forming system according to claim 4, wherein said transmission path is comprised of a serial bus.

8. A first sheet feeding apparatus feeding a sheet to an image forming apparatus, the image forming apparatus being connectable the first sheet feeding apparatus and a second sheet feeding apparatus, for forming an image on the sheet, wherein said first sheet feeding apparatus feeds the sheet to said image forming apparatus, and said second sheet feeding apparatus feeds the sheet to said first sheet feeding apparatus, the first sheet feeding apparatus comprising:

a transmission path adapted to connect said image forming apparatus and said first sheet feeding apparatus, said transmission path transmitting information between said image forming apparatus and said first sheet feeding apparatus, wherein said transmission path is comprised of a serial bus;

a signal line adapted to connect said image forming apparatus and said first sheet feeding apparatus, said signal line receiving a handover signal output from said image forming apparatus;

a conveyance unit adapted to convey a sheet to said image forming apparatus;

wherein said image forming apparatus has a first control unit adapted to transmit a feeding start request to said first sheet feeding apparatus via said transmission path, and transmit the handover signal to said first sheet feeding apparatus via said signal line after receiving a preparation-completion notification corresponding to the feeding start request from said first sheet feeding apparatus, the first sheet feeding apparatus further comprising a second control unit adapted to control said conveyance unit;

wherein the sheet is conveyed to a predetermined position of said conveyance unit as a temporary sheet waiting position in accordance with a reception of the feeding start request via said transmission path, wherein the sheet at the predetermined position is conveyed to said image forming apparatus in accordance with a reception of the handover signal via said signal line, wherein a first speed at which the sheet is conveyed to the predetermined position is faster than a second speed at which the sheet is conveyed from the predetermined position to said image forming apparatus, and said second control unit adapted to transmit the preparation-completion notification to said image forming apparatus after said conveyance unit conveys the sheet to the predetermined position;

wherein the second control unit communicates with said second sheet feeding apparatus via said transmission path to receive the sheet from said second sheet feeding apparatus, and wherein said signal line is disposed such that said first sheet feeding apparatus does not communicate with said second sheet feeding apparatus via said signal line, to receive the sheet from said second sheet feeding apparatus.

* * * * *